US007438065B2

(12) United States Patent
Matsushima et al.

(10) Patent No.: US 7,438,065 B2
(45) Date of Patent: Oct. 21, 2008

(54) BREATHER DEVICE IN ENGINE

(75) Inventors: Toshisyuki Matsushima, Tokyo (JP); Mitsugi Chonan, Tokyo (JP); Kentaro Hirota, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/889,721

(22) Filed: Aug. 15, 2007

(65) Prior Publication Data

US 2008/0041324 A1 Feb. 21, 2008

(30) Foreign Application Priority Data

Aug. 16, 2006 (JP) ..... 2006-222047
Jul. 4, 2007 (JP) ..... 2007-176282
Aug. 1, 2007 (JP) ..... 2007-200680

(51) Int. Cl.
*F01M 13/04* (2006.01)

(52) U.S. Cl. ..... 123/572; 123/573

(58) Field of Classification Search ..... 123/572–574, 123/41.86
See application file for complete search history.

(56) References Cited

U.S. PATENT DOCUMENTS 2,797,674 A * 7/1957 Dolza ..... 123/572
5,954,035 A * 9/1999 Hofer et al. ..... 123/573
6,427,672 B1 * 8/2002 Ito et al. ..... 123/572
2004/0149242 A1 * 8/2004 Hori et al. ..... 123/41.86
2007/0175458 A1 * 8/2007 Hochmayr et al. ..... 123/572

FOREIGN PATENT DOCUMENTS

JP 63-15450 4/1988
JP 2006-37884 2/2006

* cited by examiner

*Primary Examiner*—M. McMahon
(74) *Attorney, Agent, or Firm*—Smith, Gambrell & Russell, LLP

(57) ABSTRACT

A breather device disposed in a timing-gear chamber of an engine includes an oil separator rotatable with a camshaft, and a tubular breather housing that removes the oil mist by working in cooperation with the oil separator. The oil separator has a plurality of fins arranged annularly around an axis line of the camshaft at fixed intervals. The tubular breather housing has openings in a periphery wall thereof and surrounds the oil separator.

14 Claims, 13 Drawing Sheets

BREATHER DEVICE IN ENGINE

CROSS REFERENCE TO RELATED APPLICATIONS

The disclosures of Japanese Applications No. 2006-222047 filed on Aug. 16, 2006, 2007-176282 filed on Jul. 4, 2007 and 2007-200680 filed on Aug. 1, 2007 including the specifications, drawings, and abstracts are incorporated by reference herein.

BACKGROUND OF THE INVENTION

1. Field of the Invention

The present invention relates to breather devices in engines, which separate oil mist from blow-by gas containing the oil mist and allow the blow-by gas with the oil mist removed therefrom to be circulated into intake systems.

2. Description of the Related Art

Generally, in four-cycle engines, blow-by gas leaking into a crank chamber from a combustion chamber by passing through a gap between a cylinder and a piston ring is circulated into an intake system so that the gas can be re-combusted. However, when the blow-by gas leaks into the crank chamber, the gas will contain a mist of lubricating oil in the crank chamber, namely, oil mist. The oil mist is unfavorably carried to the intake system together with the blow-by gas, resulting in increased consumption of lubricating oil as well as having an adverse effect on the engine performance.

In order to solve these problems, there have been proposed various types of breather devices which separate oil mist from the blow-by gas containing the oil mist in the crank chamber so as to supply the blow-by gas having the oil mist removed therefrom to the intake system.

As an example of such a breather device, a breather device disclosed in Japanese Examined Patent Application Publication No. 63-15450 will be described below with reference to a cross-sectional view in FIG. 13.

Specifically, a cylinder head 1101 of an engine includes a head cover 1102 and a side cover 1103. The cylinder head 1101 has a timing-gear chamber 1104 therein, which communicates with a crank chamber (not shown). The timing-gear chamber 1104 communicates with an air cleaner, serving as an intake system, through a breather pipe 1105 provided in the side cover 1103. The cylinder head 1101 rotatably supports a camshaft 1106 therein, whose one end projects into the timing-gear chamber 1104. This projecting end of the camshaft 1106 has a sprocket 1107 attached thereto. The camshaft 1106 is rotated by a crankshaft (not shown) by means of a cam chain 1108 wound between the sprocket 1107 and a sprocket provided on the crankshaft.

On the other hand, a breather device 1110 includes a large-diameter rotating disk 1111 attached to the one end of the camshaft 1106 and a discharge-port member 1112 attached to an inner surface of the side cover 1103. The rotating disk 1111 is positioned closer to the side cover 1103 than the sprocket 1107 is to the side cover 1103. The discharge-port member 1112 disposed on the inner surface of the side cover 1103 includes a shielding plate 1113 functioning as a divider between the side with the timing-gear chamber 1104 and the side with the breather pipe 1105. A central portion of the shielding plate 1113 is provided with a discharge port 1113*a* through which the timing-gear chamber 1104 and the breather pipe 1105 communicate with each other. The discharge-port member 1112 also includes a cylindrical discharge-port body 1114 that is disposed within the discharge port 1113*a* and projects towards the rotating disk 1111. The discharge-port body 1114 has a flange portion 1114*a* at one end thereof, which faces a side surface of the rotating disk 1111.

In the breather device 1110 having the above-described configuration, during an operation of the engine in which the rotating disk 1111 rotates together with the camshaft 1106, blow-by gas is generated in the crank chamber and flows into the breather device 1110. Specifically, the blow-by gas flows through the timing-gear chamber 1104 and passes through a gap 1115 between the rotating disk 1111 and the flange portion 1114*a* of the discharge-port body 1114. The blow-by gas then travels through the discharge port 1113*a* so as to be supplied to an air cleaner through the breather pipe 1105. In this case, oil mist contained in the blow-by gas adheres to side surfaces of the rotating disk 1111 and the flange portion 1114*a* while passing through the gap 1115 due to the viscosity of the oil mist itself, whereby the oil mist is removed from the blow-by gas. The oil mist adhered to the rotating disk 1111 and the flange portion 1114*a* is scattered due to a centrifugal force generated upon rotation of the rotating disk 1111. The scattered oil mist travels along a wall 1104*a* of the timing-gear chamber 1104 as droplets so as to return to the crank chamber.

Another example of a breather device disclosed in Japanese Unexamined Patent Application Publication No. 2006-37884 will be described below with reference to FIG. 14.

Specifically, a cylinder head 1120 rotatably supports a camshaft 1125 therein, whose one end is provided with a flange 1126. The flange 1126 has a sprocket 1127 fixed thereto with a mounting bolt 1128. Moreover, the cylinder head 1120 has a breather chamber 1121 located next to a timing-gear chamber 1122. The breather chamber 1121 is formed by a ring-shaped flange 1123 that projects from the cylinder head 1120.

A breather device 1130 is formed by mounting a cylindrical oil separator 1132 onto the sprocket 1127 with a mounting bolt 1133. The oil separator 1132 is formed of a porous plate having a large number of pores 1132*a*. Subsequently, a breather cap 1135 holding a breather pipe 1129, whose tip end is to be inserted into the oil separator 1132, is mounted onto an outer edge 1123*a* of the ring-shaped flange 1123 with a mounting bolt (not shown).

In the breather device 1130 having the above-described configuration, during an operation of the engine in which the oil separator 1132 rotates together with the camshaft 1125, blow-by gas generated in the crank chamber flows through the timing-gear chamber 1122 and then passes through the breather chamber 1121 so as to be discharged through the breather pipe 1129. In this case, oil mist contained in the blow-by gas adheres to the oil separator 1132 so as to be removed from the blow-by gas. The oil mist adhered to the oil separator 1132 is scattered due to a centrifugal force generated upon rotation of the oil separator 1132. The scattered oil mist travels along a wall 1122*a* of the timing-gear chamber 1122 so as to be collected in the crank chamber.

According to Japanese Examined Patent Application Publication No. 63-15450, the blow-by gas generated in the crank chamber flows through the timing-gear chamber 1104 and then passes through the gap 1115 between the rotating disk 1111 and the flange portion 1114*a* of the discharge-port body 1114 so as to be introduced into an air cleaner through the breather pipe 1105. On the other hand, the oil mist contained in the blow-by gas adheres to the side surfaces of the rotating disk 1111 and the flange portion 1114*a* having the gap 1115 therebetween, whereby the oil mist is removed from the blow-by gas.

However, because the rotating disk 1111 attached to the camshaft 1106 has a relatively large diameter and the discharge-port member 1112 is large in size, the breather device 1110 occupies a large volume of space. In addition, due to having the shielding plate 1113, the discharge-port member 1112, and the rotating disk 1111, the breather device 1110 has a complex structure and an excessive number of components, which can lead to an increase in cost of manufacture.

On the other hand, in Japanese Unexamined Patent Application Publication No. 2006-37884, the blow-by gas generated in the crank chamber flows through the timing-gear chamber 1122 and then passes through the breather chamber 1121 so as to be discharged through the breather pipe 1129. The oil mist contained in the blow-by gas adheres to the oil separator 1132 so as to be removed from the blow-by gas.

However, because the breather chamber 1121 is formed by the ring-shaped flange 1123 that projects from the cylinder head 1120 having a relatively large size and a complicated shape, the cylinder head 1120 has limited design flexibility. In addition, since the oil separator 1132 is formed into a cylindrical shape using a porous plate, the oil mist adhered to the rotating oil separator 1132 will move along the surface of the rotating oil separator 1132 and will not be able to receive a desired centrifugal force. For this reason, the oil mist may possibly flow into the oil separator 1132 together with the blow-by gas through the pores 1132*a*. In that case, the oil mist may undesirably be discharged through the breather pipe 1129 together with the blow-by gas. Moreover, the flow rate of the blow-by gas flowing into the oil separator 1132 by passing through the gap between the tip end of the oil separator 1132 and the breather cap 1135 is high. This may be problematic in that a large amount of oil mist may be discharged together with the blow-by gas.

SUMMARY OF THE INVENTION

Accordingly, it is an object of the present invention to provide a simple-structured breather device in an engine that allows for high productivity and that can properly remove oil mist from blow-by gas.

A first aspect of the present invention provides a breather device in an engine including a cylinder head having a timing-gear chamber that accommodates a cam sprocket fixed to one end of a rotatably supported camshaft and communicates with a crank chamber, the cam sprocket being rotatable in conjunction with a crankshaft rotatably supported within the crank chamber, the breather device removing oil mist from blow-by gas in the engine and allowing the blow-by gas to be circulated into an intake system. The breather device includes an oil separator having a base attached to the one end of the camshaft and a plurality of fins that are spaced apart from each other and project from the base in a direction away from the camshaft; a side cover including a cover body detachably attached to a side-cover attachment part and a breather housing having a tubular portion that projects into the timing-gear chamber from the cover body and is open towards the camshaft, the side-cover attachment part being provided beside the timing-gear chamber and having an opening that faces a side surface of the cam sprocket; and a breather pipe disposed in the cover body and allowing the blow-by gas inside the oil separator to be circulated into the intake system. The breather housing has a plurality of openings in the tubular portion thereof and covers the oil separator in a rotatable manner.

The breather device according to the first aspect of the invention has a simple structure in which the oil separator having the fins can be readily mounted within the breather housing. With this simple-structured breather device, oil mist can be effectively removed from blow-by gas. Consequently, this prevents the oil mist from being carried to the intake system together with the blow-by gas, thereby minimizing the consumption of lubricating oil as well as achieving enhanced engine performance.

Furthermore, since the oil separator is mounted on the camshaft and the breather housing is provided on the side cover attached to a side of the timing-gear chamber and supporting the camshaft, a compact breather device that allows for high productivity can be achieved. In addition, the detachability of the oil separator from the side cover and the camshaft allows for easy detachment of the breather device, whereby the maintenance processes for the breather device, such as repair and inspection, can be performed smoothly and readily.

A second aspect of the present invention provides a breather device in an engine, the breather device removing oil mist contained in blow-by gas flowing into an accommodation chamber and allowing the blow-by gas to be circulated into an intake system, the accommodation chamber accommodating a timing transmission mechanism that transmits rotation of a crankshaft of the engine to a camshaft. The breather device includes an oil separator including at least one annular fin array having a plurality of fins projecting into the accommodation chamber from one end of the camshaft and arranged annularly around an axis line of the camshaft at certain intervals; a side cover detachably attached to one side of the accommodation chamber; a tubular breather housing projecting into the accommodation chamber from the side cover and accommodating at least a part of the oil separator; and a breather pipe attached to the side cover and communicating with an inside of the breather housing, the breather pipe allowing the blow-by gas with the oil mist removed therefrom by the oil separator to be circulated into the intake system.

The breather device according to the second aspect of the invention has a simple structure in which at least a part of the oil separator having the fins is accommodated and mounted within the breather housing. With this simple-structured breather device, oil mist can be effectively removed from blow-by gas. Consequently, this prevents the oil mist from being carried to the intake system together with the blow-by gas, thereby minimizing the consumption of lubricating oil as well as achieving enhanced engine performance.

In the breather device according to the second aspect, the oil separator may include a plurality of annular fin arrays. In this case, the breather housing may be disposed between the plurality of annular fin arrays and may partially accommodate the annular fin arrays.

The oil separator constituted by the plurality of annular fin arrays further facilitates the collision of the blow-by gas against the annular fin arrays as compared to an oil separator having only a single annular fin array. Accordingly, the oil mist can be removed from the blow-by gas more effectively, thereby enhancing the gas-liquid separation effect.

Furthermore, in the breather device according to the second aspect, each of the fins is preferably in a form of a rectangular plate and is preferably slanted such that a leading edge of the fin, as viewed in a rotational direction of the camshaft, is closer to the axis line of the camshaft than a trailing edge of the fin is to the axis line.

Accordingly, as viewed in a rotational direction of the fins on the rotating oil separator, each of the fins may be slanted such that the trailing edge thereof is farther from the axis line than the leading edge thereof is from the axis line. When oil mist flows into the breather housing together with blow-by gas through openings in the breather housing, the oil mist adheres to outer surfaces of the fins. The oil mist adhered to the outer surfaces of the fins receives a centrifugal force and wind pressure generated upon rotation of the oil separator, thereby causing the oil mist to flow towards the trailing edges of the fins along the outer surfaces of the fins. At the trailing edges, the oil mist becomes in a state of oil droplets and receives a large centrifugal force. This large centrifugal force causes the oil mist to scatter effectively, whereby the oil mist can be separated from the blow-by gas.

Furthermore, in the breather device according to the second aspect, the breather pipe may have an inlet port for the blow-by gas, the inlet port being disposed on the axis line of the camshaft.

Accordingly, the blow-by gas introduced into the interior of the oil separator flows in a revolving manner within the oil separator upon rotation of the oil separator. This flowing of the blow-by gas in a revolving manner causes the oil mist having relatively greater density to move outward and the blow-by gas with less density to be maintained near the center of the oil separator. The blow-by gas near the center of the oil separator, which only has an extremely small amount of oil mist remaining therein, is released towards the intake system of the engine through the inlet port of the breather pipe.

Furthermore, in the breather device according to the second aspect, the breather housing preferably has a plurality of substantially U-shaped openings that are open at a tip-end side of the breather housing, each of the substantially U-shaped openings being defined by opposite side edges extending along the axis line of the camshaft and by a base-side edge that connects ends of the opposite side edges.

Accordingly, by providing the openings at the tip-end side of the breather housing, the openings can be given relatively large dimensions. This can reduce the flow rate of the blow-by gas flowing into the oil separator.

Furthermore, the fins have tip ends in an axial direction of the camshaft, and the tip ends of the fins are preferably positioned closer towards the cover body than the base-side edges of the openings in the breather housing are towards the cover body.

Accordingly, since the tip ends of the fins on the oil separator may be disposed closer towards the cover body of the side cover than the base-side edges of the openings in the breather housing are towards the cover body, the blow-by gas that has flowed into the breather housing through the openings in the breather housing will need to flow by a roundabout way around the tip ends of the fins on the oil separator in order to reach the interior of the oil separator. This inhibits the blow-by gas from directly flowing into the interior of the oil separator, whereby the oil separator can effectively remove the oil mist from the blow-by gas.

Furthermore, in the breather device according to the second aspect, the breather housing has a tip end in an axial direction of the camshaft, and the tip end of the breather housing may abut on a side surface of the timing transmission mechanism.

Accordingly, since the tip end of the breather housing in the axial direction of the camshaft may abut on the side surface of the timing transmission mechanism, the camshaft can be restricted from moving in the axial direction thereof, thereby allowing for smooth rotation of the camshaft.

Furthermore, in the breather device according to the second aspect, the oil separator and the timing transmission mechanism are preferably fixed together with a mounting bolt to the one end of the camshaft projecting into the accommodation chamber.

Accordingly, the timing transmission mechanism and the oil separator can be readily attached to and detached from the camshaft by means of a single mounting bolt, thereby achieving excellent assembly workability.

A third aspect of the present invention provides a breather device in an engine, in which the breather device includes an oil separator that removes oil mist contained in blow-by gas flowing into an accommodation chamber and allows the blow-by gas to be circulated into an intake system, the accommodation chamber accommodating a timing transmission mechanism that transmits rotation of a crankshaft of the engine to a camshaft, the oil separator being attached to one end of the camshaft. The oil separator includes a plurality of annular fin arrays, each annular fin array having a plurality of fins projecting from the one end of the camshaft and arranged annularly around an axis line of the camshaft at certain intervals.

Accordingly, the oil separator constituted by the plurality of annular fin arrays further facilitates the collision of the blow-by gas against the annular fin arrays as compared to an oil separator having only a single annular fin array. Accordingly, the oil mist can be removed from the blow-by gas more effectively, thereby enhancing the gas-liquid separation effect.

Furthermore, in the breather device according to the third aspect, the plurality of annular fin arrays preferably includes an inner annular fin array and an outer annular fin array disposed radially adjacent to each other in the oil separator. In this case, the number of fins in the inner annular fin array is preferably different from the number of fins in the outer annular fin array, and moreover, the inner and outer annular fin arrays are preferably disposed such that the fins in the outer annular fin array at least partially overlap the gaps between the fins in the inner annular fin array.

Accordingly, at any mounting angles of the annular fin arrays, the gaps in the inner annular fin array through which the blow-by gas passes can be made to partially overlap the fins in the outer annular fin array. This prevents the gas-liquid separation effect from varying with the mounting angles of the annular fin arrays, whereby the gas-liquid separation effect can be achieved uniformly. In addition, the annular fin arrays can be attached at arbitrary mounting angles without having to pay special attention to the mounting angles, thereby contributing to enhanced workability.

Furthermore, in the breather device according to the third aspect, each of the fins is preferably slanted such that a leading edge of the fin, as viewed in a rotational direction of the camshaft, is closer to the axis line of the camshaft than a trailing edge of the fin is to the axis line.

Accordingly, the oil mist can readily adhere to the outer surfaces of the fins, and the adhered oil mist is forced to flow towards the trailing edges of the fins along the outer surfaces thereof due to the centrifugal force and wind pressure generated upon rotation of the oil separator. The oil mist becomes in a state of oil droplets at the trailing edges of the fins and thus scatters due to receiving a large centrifugal force. Consequently, this enhances the separation effect of the oil mist from the blow-by gas.

Furthermore, the breather device according to the third aspect may further include a side cover having a cover body detachably attached to one side of the accommodation chamber and a tubular breather housing projecting into the accommodation chamber from the cover body and being open towards the camshaft. In this case, the breather housing preferably has a plurality of openings arranged along a circumference thereof, and the breather housing is preferably disposed between the annular fin arrays and is spaced apart from the annular fin arrays by predetermined distances, the annular fin arrays being disposed radially adjacent to each other in the oil separator.

Accordingly, when the blow-by gas that has passed through the outer annular fin array travels through the openings in the breather housing so as to flow towards the inner annular fin array, the breather housing has a so-called labyrinth effect on the flowing blow-by gas. This effect further enhances the gas-liquid separation effect as the blow-by gas flows, whereby the oil mist can be separated from the blow-by gas even more effectively.

Accordingly, the present invention provides a simple-structured breather device that rotates a finned oil separator attached to a camshaft. With this breather device, oil mist can be effectively removed from blow-by gas so that the amount of oil mist carried to an intake system together with the blow-by gas can be minimized, thereby minimizing waste of lubricating oil as well as maintaining good engine performance.

DESCRIPTION OF THE PREFERRED EMBODIMENTS

Embodiments of a breather device in an engine according to the present invention will be described below with reference to the drawings.

First Embodiment

Figure 1:
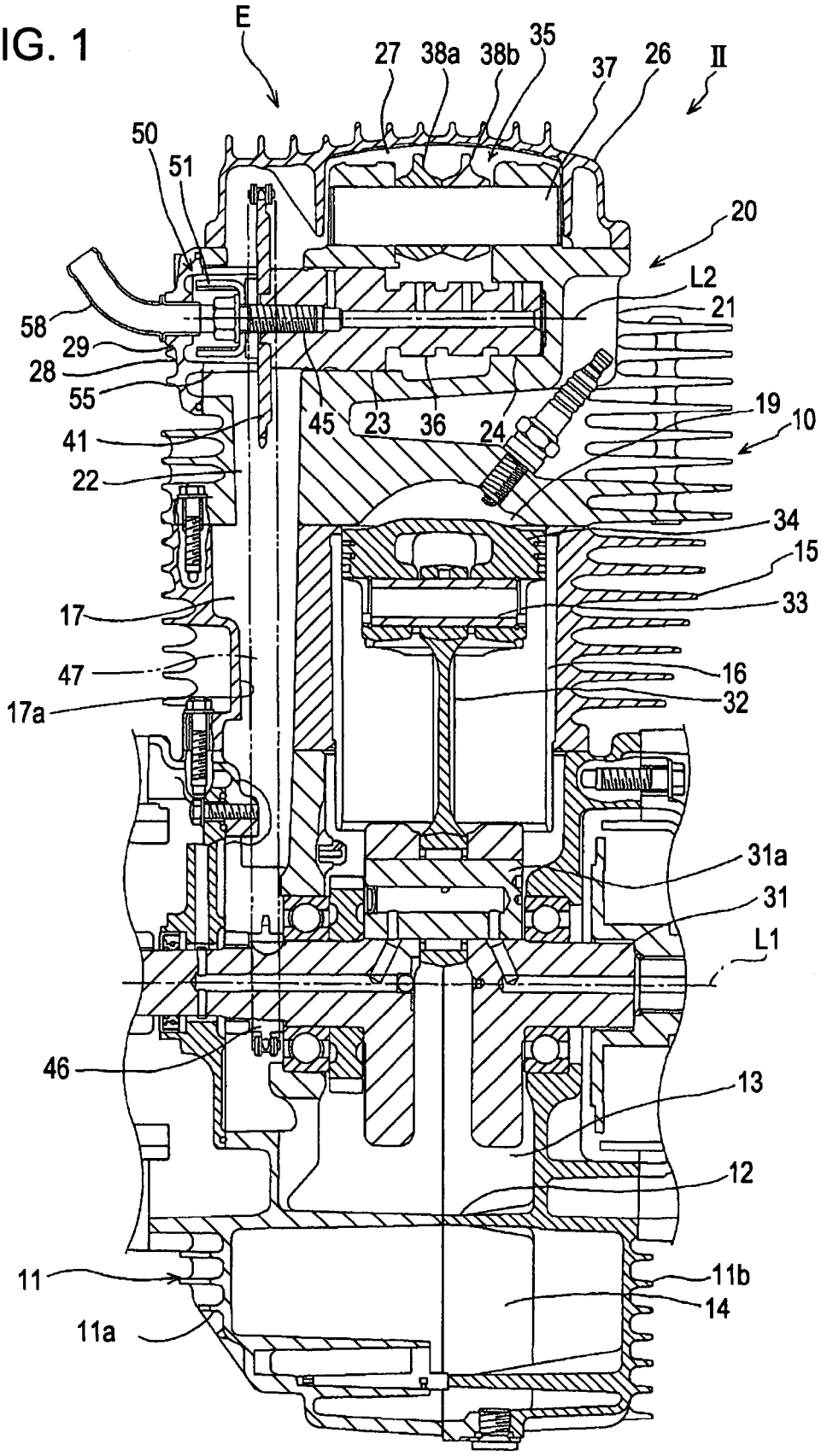
FIG. 1 is a cross-sectional view of an engine having a breather device according to a first embodiment of the present invention.
Figure 2:
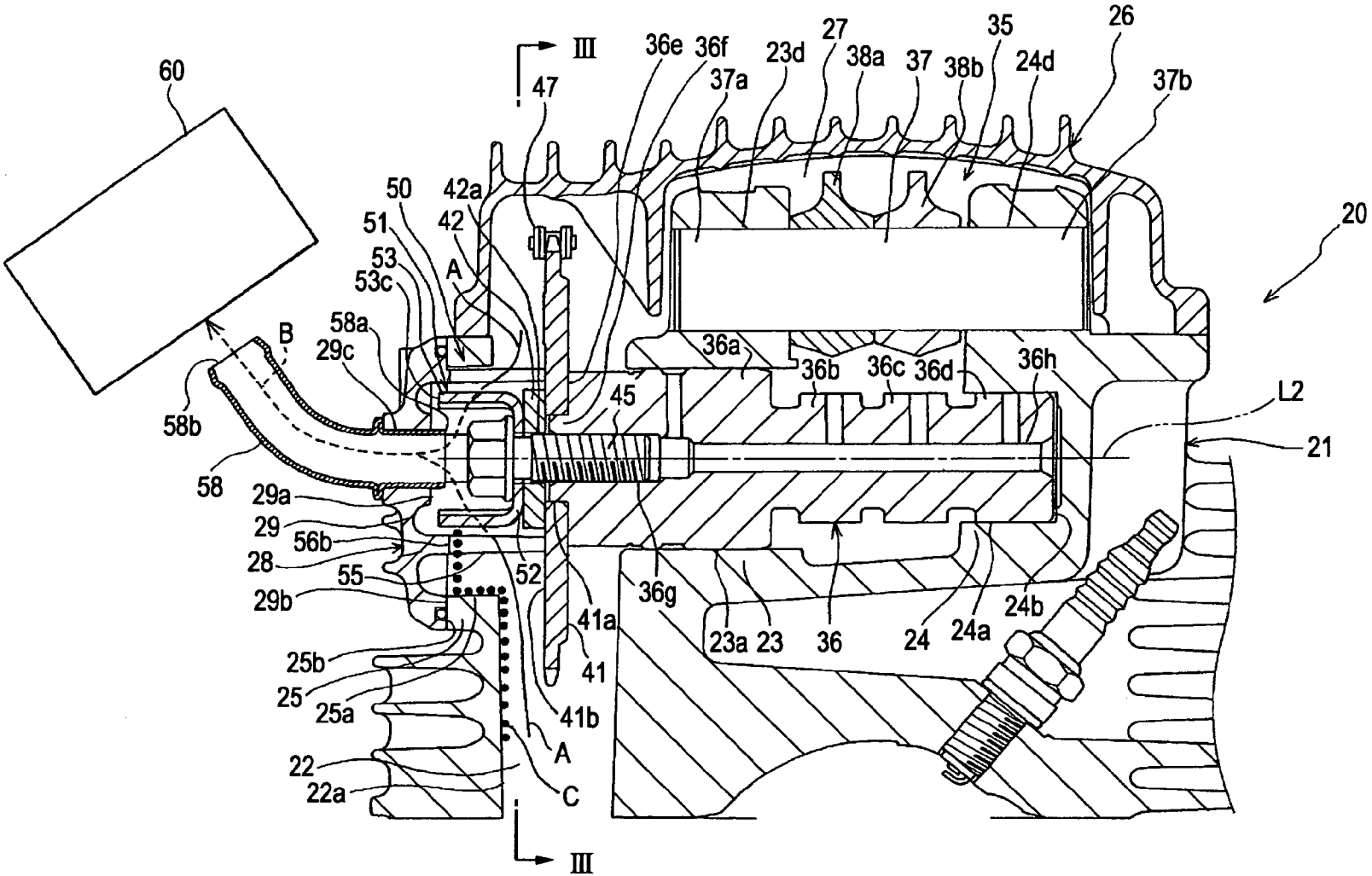
FIG. 2 is an enlarged cross-sectional view of part II in FIG. 1.
Figure 3:
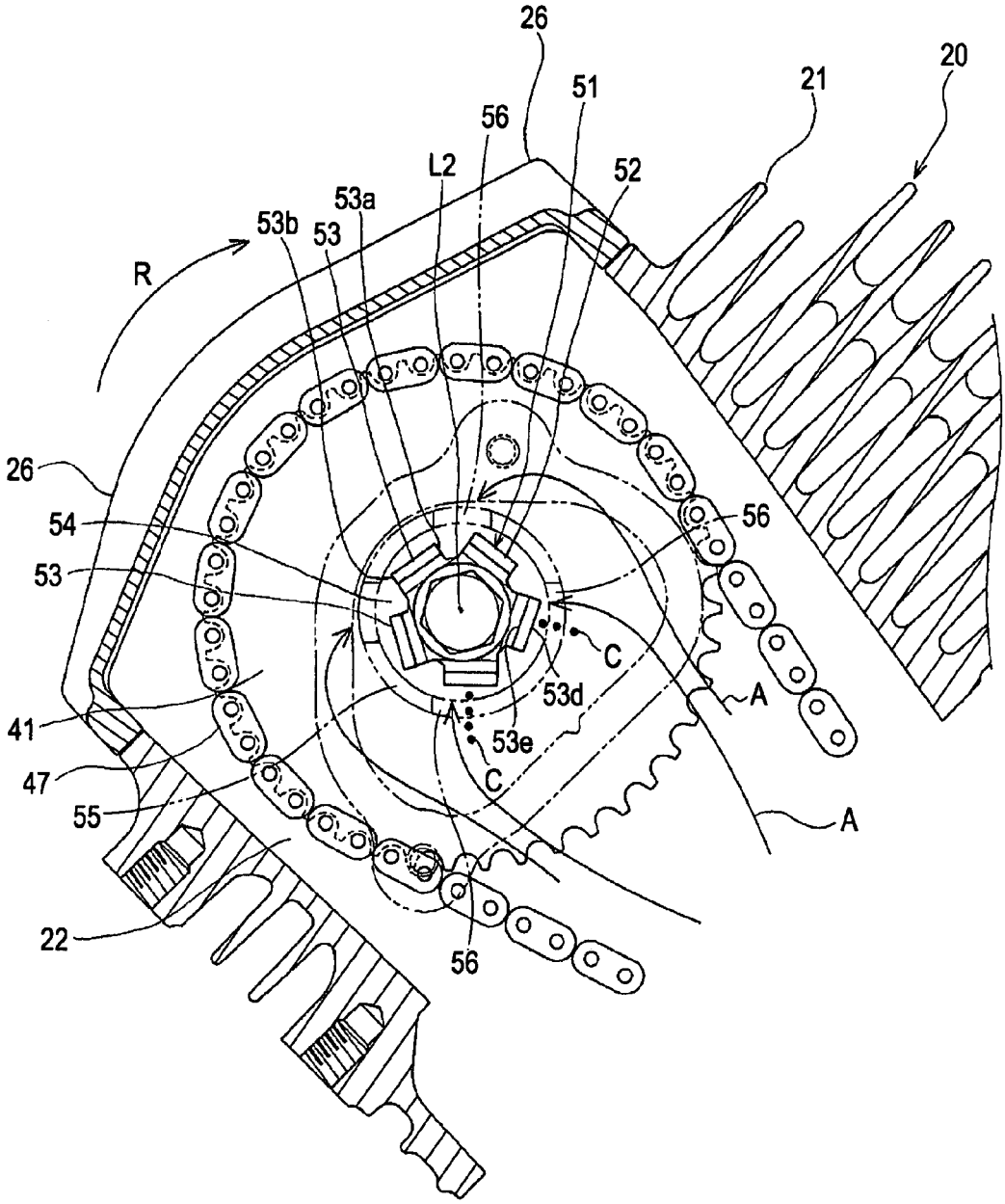
FIG. 3 is a cross-sectional view taken along line III-III in FIG. 2.
Figure 4:
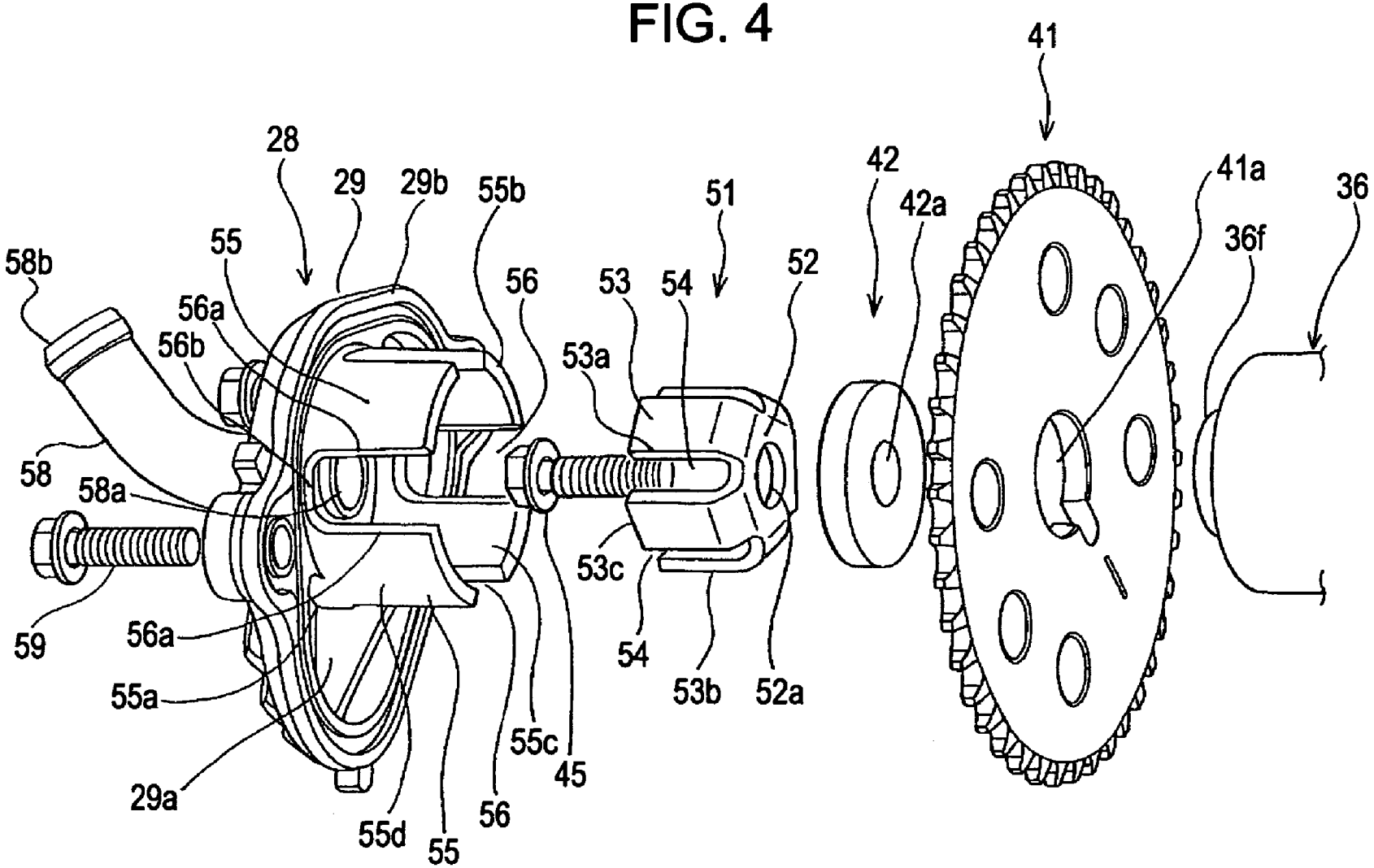
FIG. 4 is an exploded perspective view showing a relevant part of the breather device shown in FIG. 1.
Figure 5:
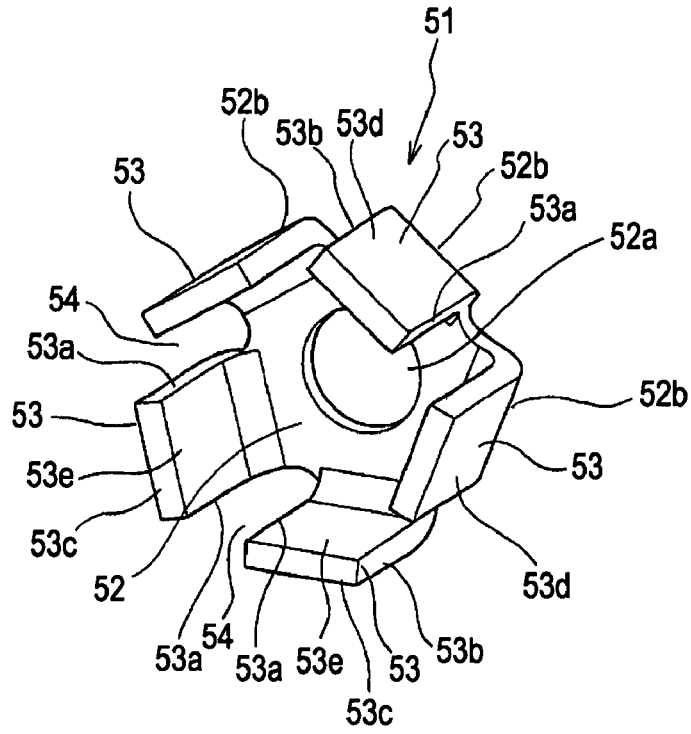
FIG. 5 is a perspective view of an impeller constituting an oil separator of the breather device shown in FIG. 1.
Figure 6:
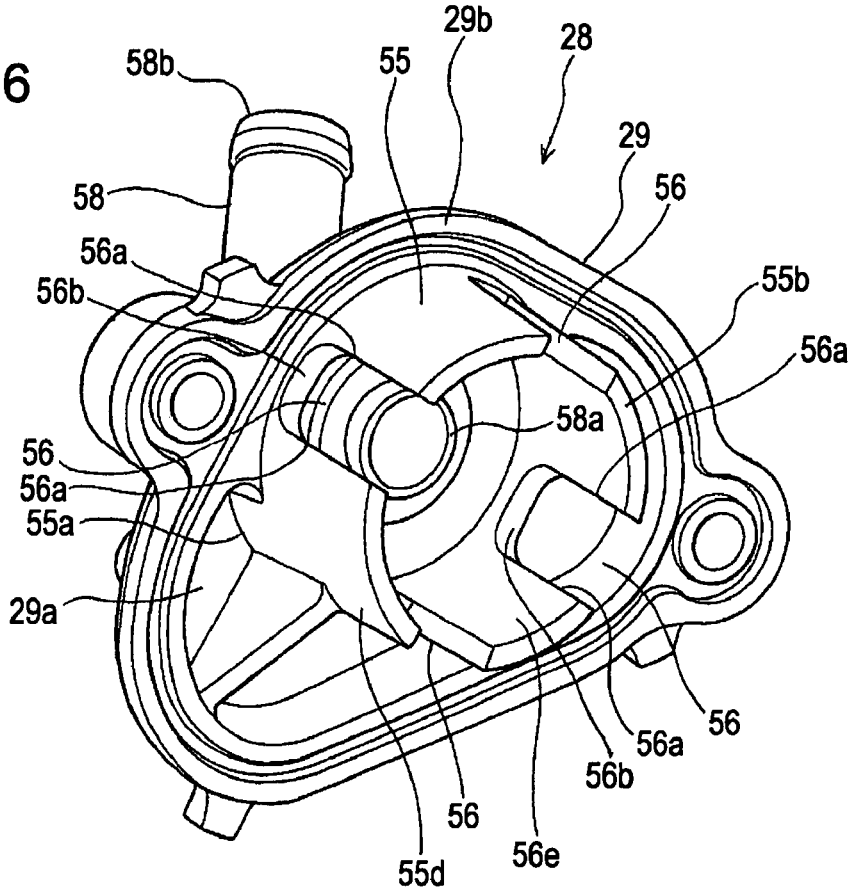
FIG. 6 is a perspective view of a side cover of the breather device shown in FIG. 1.

FIGS. 1 to 6 illustrate a first embodiment of the present invention. FIG. 1 is a cross-sectional view of an engine having a breather device according to the first embodiment of the present invention. FIG. 2 is an enlarged view of part II in FIG. 1. FIG. 3 is a cross-sectional view taken along line III-III in FIG. 2. FIG. 4 is an exploded perspective view showing a relevant part of the breather device according to the first embodiment. FIG. 5 is a perspective view of an oil separator. FIG. 6 is a perspective view of a side cover having a breather housing.

An engine E is a single-cylinder four-cycle overhead camshaft (OHC) engine. Referring to FIG. 1, an engine body 10 of the engine E includes a crankcase 11, a cylinder block 15 joined to the crankcase 11 with a bolt, and a cylinder head 20 joined to the top of the cylinder block 15 with a bolt. The crankcase 11 is formed of a pair of left and right case components 11*a* and 11*b* that are joined together with a bolt.

The crankcase 11 formed of the case components 11*a* and 11*b* has a crank chamber 13 that supports a crankshaft 31 rotatable about an axis line L1 and an oil chamber 14 located below the crank chamber 13. The crank chamber 13 and the oil chamber 14 are divided by a partition wall 12.

The crankshaft 31 has a crankpin 31*a* to which a piston 34 is linked by means of a connecting rod 32 and a piston pin 33. The piston 34 is slidably fitted within a cylinder 16 provided in the cylinder block 15 with a piston ring (not shown) interposed therebetween. The crankshaft 31 is provided with a sprocket 46. The cylinder block 15 has a communication path 17 which extends along the cylinder 16 and whose lower end communicates with the crank chamber 13.

The cylinder head 20 has an intake port and an exhaust port that are connected to a combustion chamber 19 and to a carburetor and an exhaust muffler (not shown), respectively. The cylinder head 20 also has an intake valve and an exhaust valve that open and close the respective intake port and exhaust port. Moreover, the cylinder head 20 has disposed therein a valve-operating mechanism 35 for driving the intake valve and the exhaust valve. Specifically, the valve-operating mechanism 35 includes, for example, a camshaft 36, a rocker shaft 37, an exhaust rocker arm 38*a*, and an intake rocker arm 38*b*. The engine E is a so-called inclined engine in which the direction of reciprocation of the piston 34 is inclined with respect to the vertical direction.

Referring to FIGS. 2 and 3, the cylinder head 20 includes a cylinder-head body 21, a rocker cover 26 attached to the cylinder-head body 21 with a mounting bolt, and a side cover 28.

The cylinder-head body 21 has a timing-gear chamber 22 that communicates with the crank chamber 13 through the communication path 17 in the cylinder block 15. Furthermore, in order for the camshaft 36 to be fitted in the cylinder-head body 21, the cylinder-head body 21 has a first camshaft hole 23*a* and a second camshaft hole 24*a* having a diameter smaller than that of the first camshaft hole 23*a*. The first camshaft hole 23*a* extends through a first camshaft-support section 23 such that one end of the first camshaft hole 23*a* is open to the timing-gear chamber 22. On the other hand, the second camshaft hole 24*a* extends through a second camshaft-support section 24 and has a cylindrical shape with a closed end defined by a base 24*b*.

The camshaft 36 has a first shaft-engagement portion 36*a* rotatably engaged with the first camshaft hole 23*a*, an exhaust cam 36*b*, an intake cam 36*c*, and a second shaft-engagement portion 36*d* rotatably engaged with the second camshaft hole 24*a*, which are provided in that order along an axis line L2. One end of the camshaft 36 that projects from the first camshaft hole 23*a* towards the timing-gear chamber 22 has a shoulder portion 36*e* from which a sprocket attachment portion 36*f* protrudes concentrically with the camshaft 36.

This one end of the camshaft 36 is provided with a threaded hole 36*g* that extends from an end surface of the sprocket attachment portion 36*f* towards the other end of the camshaft 36 along the axis line L2. The camshaft 36 also has an oil hole 36*h* through which lubricating oil from an oil pump can be directly supplied or sprayed to slidable portions such as the first shaft engagement portion 36*a* and the second shaft engagement portion 36*d*.

The first camshaft-support section 23 and the second camshaft-support section 24 respectively have a first rocker-shaft support hole 23*d* and a second rocker-shaft support hole 24*d* that support respective ends 37*a* and 37*b* of the rocker shaft 37. The rocker shaft 37 axially supports the exhaust rocker arm 38*a* and the intake rocker arm 38*b*. One end of the exhaust rocker arm 38*a* abuts on the top of the exhaust valve, whereas the other end abuts on the exhaust cam 36*b*. Similarly, one end of the intake rocker arm 38*b* abuts on the top of the intake valve, whereas the other end abuts on the intake cam 36*c*. Accordingly, when the exhaust rocker arm 38*a* and the intake rocker arm 38*b* rock in response to rotation of the camshaft 36, the rocker arms 38*a* and 38*b* push the exhaust valve and the intake valve to open the exhaust port and the intake port, respectively.

Referring to FIGS. 1 and 2, the rocker cover 26 is mounted above the cylinder-head body 21 so as to cover the timing-gear chamber 22 from above and also to cover the rocker shaft 37 from above to form a valve-operating chamber 27.

One side of the cylinder-head body 21 having the timing-gear chamber 22 is provided with an annular side-cover attachment part 25. The side-cover attachment part 25 extends over a plane that is orthogonal to the camshaft 36. The side-cover attachment part 25 has an inner periphery surface 25*a* that continues from a wall 22*a* of the timing-gear chamber 22 and also has an outer end surface 25*b*.

As shown in FIGS. 1 and 2, the timing-gear chamber 22 accommodates a sprocket 41 and a breather device 50.

The sprocket 41 has a shaft hole 41*a* that is fitted to the sprocket attachment portion 36*f* of the camshaft 36. Moreover, the sprocket 41 has a thickness that is slightly larger than the length of the sprocket attachment portion 36*f*. The sprocket 41 having such a structure is attached to the one end of the camshaft 36 projecting into the timing-gear chamber 22 from the first camshaft-support section 23 such that the sprocket 41 is coaxially aligned with the axis line L2.

The breather device 50 includes an oil separator 51 and a breather housing 55.

Referring to FIGS. 4 and 5, the oil separator 51 has a polygonal plate-like base 52 having a mounting hole 52*a* in the center and having a plurality of linear edges 52*b* around the outer periphery of the base 52. In this embodiment, the base 52 is pentagonal. The oil separator 51 also has flat rectangular fins 53 that are arranged annularly at fixed intervals around the base 52 and are bent substantially perpendicular to the base 52 in a direction away from the camshaft 36 so as to extend from the respective edges 52*b* of the base 52 along the axis line L2. The fins 53 constitute an annular fin array. Referring to FIG. 3, each of these fins 53 is slanted such that a leading edge 53*a* thereof, as viewed in a rotational direction R of the camshaft 36, is closer to the axis line L2 than a trailing edge 53*b* thereof is to the axis line L2. In other words, the trailing edge 53*b* is farther from the axis line L2 than the leading edge 53*a* is from the axis line L2. Furthermore, the leading edges 53*a* and the trailing edges 53*b* of the adjacent fins 53 have gaps 54 therebetween that extend in the direction of the axis line L2.

Referring to FIGS. 2 and 4, the sprocket 41, the oil separator 51, and the camshaft 36 are joined to one another by first fitting the shaft hole 41*a* onto the sprocket attachment portion 36*f* of the camshaft 36 in order to mount the sprocket 41 to the camshaft 36. Subsequently, the base 52 of the oil separator 51 is abutted against and positioned on a side surface 41*b* of the sprocket 41 with a disc-shaped spacer 42 interposed therebetween. Specifically, the disc-shaped spacer 42 is provided with a bolt through-hole 42*a* and has a diameter greater than that of the shaft hole 41*a* of the sprocket 41. While the base 52 is in such a positioned state, a mounting bolt 45 is inserted through the mounting hole 52*a* of the oil separator 51 and then through the bolt through-hole 42*a* of the spacer 42 so as to be bolted into the threaded hole 36*g* of the camshaft 36. In this manner, the sprocket 41 and the oil separator 51 are secured together to the camshaft 36. Accordingly, this structure allows the sprocket 41 and the oil separator 51 to be readily attached to and detached from the camshaft 36 by means of a single mounting bolt 45, thereby achieving enhanced assembly workability.

The sprocket 41 secured to the camshaft 36 rotates in conjunction with the sprocket 46 on the crankshaft 31 by means of a cam chain 47 extending through the communication path 17 in the cylinder block 15. Consequently, when the crankshaft 31 rotates, the camshaft 36 and the oil separator 51 are rotated through a timing transmission mechanism constituted by the sprocket 46, the cam chain 47, and the sprocket 41. The communication path 17 and the timing-gear chamber 22 communicating with the communication path 17 constitute an accommodation chamber that accommodates the timing transmission mechanism.

Referring to FIGS. 2 and 6, the side cover 28 has a cover body 29 whose rim surface 29*b* abuts on the outer end surface 25*b* of the side-cover attachment part 25 so as to cover one side of the timing-gear chamber 22. The side cover 28 is attached to the cylinder-head body 21 with mounting bolts 59 (see FIG. 4).

The cover body 29 has an inner surface 29*a* from which the breather housing 55 having a cylindrical shape projects along the axis line L2. Specifically, the cylindrical breather housing 55 has a base end 55*a* connected to the inner surface 29*a*, an inner periphery surface 55*c*, and an outer periphery surface 55*d*. The breather housing 55 has an inner diameter that is larger than the diameter of the oil separator 51, and covers the oil separator 51 in a rotatable manner. The breather housing 55 is disposed with a gap between the outer periphery surface 55*d* thereof and the inner periphery surface 25*a* of the side-cover attachment part 25. Furthermore, the breather housing 55 has a tip end 55*b* that faces and abuts the side surface 41*b* of the sprocket 41 so as to restrict the movement of the camshaft 36 in the axial direction thereof, whereby the camshaft 36 can be maintained at a predetermined position.

The breather housing 55 has a plurality of substantially U-shaped openings 56 that are open at the side of the tip end 55*b* and are arranged along the circumference of the breather housing 55. Specifically, each substantially U-shaped opening 56 is defined by opposite side edges 56*a* that extend along the axis line L2 and by a base-side edge 56*b* that connects the ends of the opposite side edges 56*a* proximate to the base end 55*a*. In this embodiment, the breather housing 55 is given four openings 56 arranged annularly at equal intervals. The base-side edges 56*b* of the openings 56 are formed so as to be closer towards the camshaft 36 than tip ends 53*c* of the fins 53 of the oil separator 51 are towards the camshaft 36. In a state where the side cover 28 is attached to the side-cover attachment part 25 of the cylinder-head body 21, any one of the openings 56 in the breather housing 55 is preferably set at a downward position. These U-shaped openings 56 can be readily formed mechanically by, for example, cutting from the side of the tip end 55*b*.

The cover body 29 of the side cover 28 also has a breather-pipe attachment hole 29*c* that is coaxially aligned with the axis line L2 and allows communication between the inside of the breather housing 55 and the outside. The breather-pipe attachment hole 29*c* holds a breather pipe 58 by allowing the breather pipe 58 to be fitted therein. The breather pipe 58 has an inlet port 58*a* that protrudes into the breather housing 55 from the inner surface 29*a* of the cover body 29, and an outlet port 58*b* that communicates with an intake system, such as an air cleaner 60 (see FIG. 2).

In the breather device 50 having the above-described configuration, when the engine E is in operation, the oil separator 51 rotates within the breather housing 55 upon rotation of the camshaft 36. During the operation of the engine E, blow-by gas is generated and flows into the timing-gear chamber 22. The blow-by gas then flows from the timing-gear chamber 22 and into the breather housing 55 through the openings 56. Furthermore, the blow-by gas flows into the interior of the rotating oil separator 51 by passing through the gaps 54 of the oil separator 51. Finally, the blow-by gas travels through the breather pipe 58 so as to be discharged to the air cleaner 60.

On the other hand, oil mist flowing into the breather housing 55 together with the blow-by gas adheres to the fins 53 of the oil separator 51 due to the viscosity of the oil mist itself, whereby the oil mist is removed from the blow-by gas. The blow-by gas with the oil mist removed therefrom is subsequently supplied to the air cleaner 60. The oil mist adhered to the fins 53 of the oil separator 51 is scattered radially due to a centrifugal force generated upon rotation of the oil separator 51, and is received by the breather housing 55. The oil mist received by the breather housing 55 flows downward through the openings 56 of the breather housing 55 and travels along the wall 22*a* of the timing-gear chamber 22 and a wall 17*a* of the communication path 17 as droplets so as to return to the crank chamber 13. A detailed description of the operation of the breather device 50 will be provided below.

Lubrication of the engine E is implemented by driving an oil pump (not shown) during an operation of the engine E so as to supply lubricating oil in the oil chamber 14 to lubrication sections in the crank chamber 13 and to lubrication sections in the valve-operating mechanism 35 disposed within the cylinder head 20. The lubricating oil that has been used for lubricating the lubrication sections is collected in the crank chamber 13. For example, the lubricating oil used for lubricating the valve-operating mechanism 35 becomes in a state of mist or oil mist, and travels along the wall 22*a* of the timing-gear chamber 22 and the wall 17*a* of the communication path 17 as droplets so as to be collected in the crank chamber 13. The lubricating oil collected in the crank chamber 13 is returned to the oil chamber 14 through a valve hole (not shown) located in the partition wall 12. Specifically, this valve hole opens and closes in accordance with differential pressure between the crank chamber 13 and the oil chamber 14 that occurs due to pressure fluctuation in the crank chamber 13.

The operation of the breather device 50 will now be described. When the engine E is in operation, blow-by gas leaks from the combustion chamber 19 to flow into the crank chamber 13 by passing through a gap between the cylinder 16 in the cylinder block 15 and the piston 34 or the piston ring. The blow-by gas flowed into the crank chamber 13 then travels through the accommodation chamber for the timing transmission mechanism, that is, the communication path 17 and the timing-gear chamber 22, due to pressure fluctuation in the crank chamber 13. The blow-by gas is thus introduced into the breather housing 55 through the openings 56 of the breather housing 55. Subsequently, the blow-by gas in the breather housing 55 is supplied to the air cleaner 60 through the breather pipe 58.

On the other hand, the crank chamber 13 contains oil mist scattered from the rotating crankshaft 31, oil mist to be used for lubricating the lubrication sections, and oil mist that has been collected after being used for lubricating the lubrication sections.

Likewise, in the valve-operating chamber 27, lubricating oil is scattered from the rotating camshaft 36, and a portion of the lubricating oil exists in the valve-operating chamber 27 in a form of oil mist. The scattered lubricating oil and oil mist in the valve-operating chamber 27 flow into the timing-gear chamber 22 from the valve-operating chamber 27 and travels along the wall 22*a* of the timing-gear chamber 22 and the wall 17*a* of the communication path 17 as droplets so as to be collected in the crank chamber 13. When the sprocket 46 and the sprocket 41 provided on the camshaft 36 rotate upon rotation of the crankshaft 31, the lubricating oil adhered to the sprockets 41 and 46 and the cam chain 47 is scattered within the communication path 17 and the timing-gear chamber 22.

Therefore, blow-by gas that has passed through the crank chamber 13 filled with oil mist and through the communication path 17 and the timing-gear chamber 22 contains a large amount of oil mist. The flow of the blow-by gas containing the oil mist is schematically shown with solid lines A in FIGS. 2 and 3.

When the blow-by gas flows into the breather housing 55 through the openings 56, the gas comes into contact with the fins 53 of the rotating oil separator 51. In this case, the oil mist contained in the blow-by gas adheres to the fins 53 due to the viscosity of the oil mist itself, and thus is separated from the blow-by gas. The blow-by gas with the oil mist removed therefrom by the oil separator 51 flows into the interior of the oil separator 51 by passing through the gaps 54 of the oil separator 51. Finally, the blow-by gas is supplied to the air cleaner 60 through the breather pipe 58. The flow of the blow-by gas with the oil mist removed therefrom is schematically shown with a dashed line B in FIG. 2.

On the other hand, the oil mist adhered to the fins 53 of the oil separator 51 is scattered radially due to the centrifugal force generated by the rotating oil separator 51. The scattered oil mist is received by the inner periphery surface 55*c* of the breather housing 55 and drips to the inner periphery surface 25*a* of the side-cover attachment part 25 through the openings 56 of the breather housing 55. The oil mist then travels along the wall 22*a* of the timing-gear chamber 22 and along the wall 17*a* of the communication path 17 in the cylinder block 15 as droplets so as to be collected in the crank chamber 13. The flow of the oil mist is schematically shown with dots C in FIGS. 2 and 3.

More specifically, as mentioned above, the fins 53 of the oil separator 51 have a slanted structure in which the trailing edges 53*b* thereof are farther from the axis line L2 than the leading edges 53*a* are from the axis line L2. When the oil mist adheres to outer surfaces 53*d* of the fins 53, the centrifugal force and wind pressure generated upon rotation of the oil separator 51 cause the oil mist to flow towards the trailing edges 53*b* of the fins 53 along the outer surfaces 53*d*. At the trailing edges 53*b*, the oil mist becomes in a state of relatively large oil droplets. The oil mist now in the state of oil droplets receives a large centrifugal force and can thus scatter radially effectively, whereby the oil mist can mostly be separated from the blow-by gas.

The blow-by gas with most of the oil mist removed therefrom and introduced into the interior of the oil separator 51 flows in a revolving manner within the oil separator 51 upon rotation of the oil separator 51. This flowing of the blow-by gas in a revolving manner causes the blow-by gas with less density to be maintained near the center of the oil separator 51, that is, near the axis line L2 within the oil separator 51. On the other hand, since the oil mist remaining in the blow-by gas has a relatively greater density, the oil mist flows outward due to the centrifugal force so as to adhere to inner surfaces 53*e* of the fins 53. The oil mist is thus separated from the blow-by gas. The blow-by gas near the center of the oil separator 51, which only has an extremely small amount of oil mist remaining therein, is released towards the air cleaner 60 through the inlet port 58*a* of the breather pipe 58 coaxially aligned with the axis line L2.

The tip ends 53*c* of the fins 53 on the oil separator 51 are disposed closer towards the cover body 29 of the side cover 28 than the base-side edges 56*b* of the openings 56 in the breather housing 55 are towards the cover body 29. Consequently, This inhibits the blow-by gas flowing into the breather housing 55 from directly flowing into the interior of the oil separator 51 by a roundabout way around the tip ends 53*c* of the fins 53 on the oil separator 51, whereby the oil separator 51 can effectively remove the oil mist from the blow-by gas.

Furthermore, the openings 56 in the breather housing 55 and the gaps 54 in the oil separator 51 can be given relatively large dimensions. Consequently, due to the large dimensions of these inflow ports, the flow rate of blow-by gas flowing into the oil separator 51 by passing through the openings 56 and the gaps 54 can be prevented from increasing. This inhibits the oil mist from flowing into the oil separator 51 together with the blow-by gas.

According to the first embodiment, the breather device 50 has a simple configuration that can be formed by attaching the oil separator 51 having the fins 53 into the breather housing 55. With this breather device 50, the oil mist can be effectively removed from the blow-by gas. Accordingly, the breather device 50 can prevent oil mist from being discharged together with blow-by gas to an intake system, thereby minimizing the consumption of lubricating oil as well as maintaining good engine performance.

In addition, since the oil separator 51 is mounted on the camshaft 36 and the breather housing 55 is provided on the side cover 28, the breather device 50 can be made compact and can allow for higher productivity. Furthermore, the detachability of the oil separator 51 from the side cover 28 and the camshaft 36 allows for easy detachment of the breather device 50, whereby the maintenance processes for the breather device 50, such as repair and inspection, can be performed smoothly and readily.

Furthermore, the breather device 50 has a simple configuration that includes the oil separator 51 mounted on the camshaft 36 and the breather housing 55 mounted on the side cover 28. Accordingly, the breather device 50 can be installed in a pre-existing engine not having a breather device by performing an extremely simple modification process that includes attaching the oil separator 51 to a camshaft and replacing a side cover with the side cover 28 having the breather housing 55.

Second Embodiment

Figure 7:
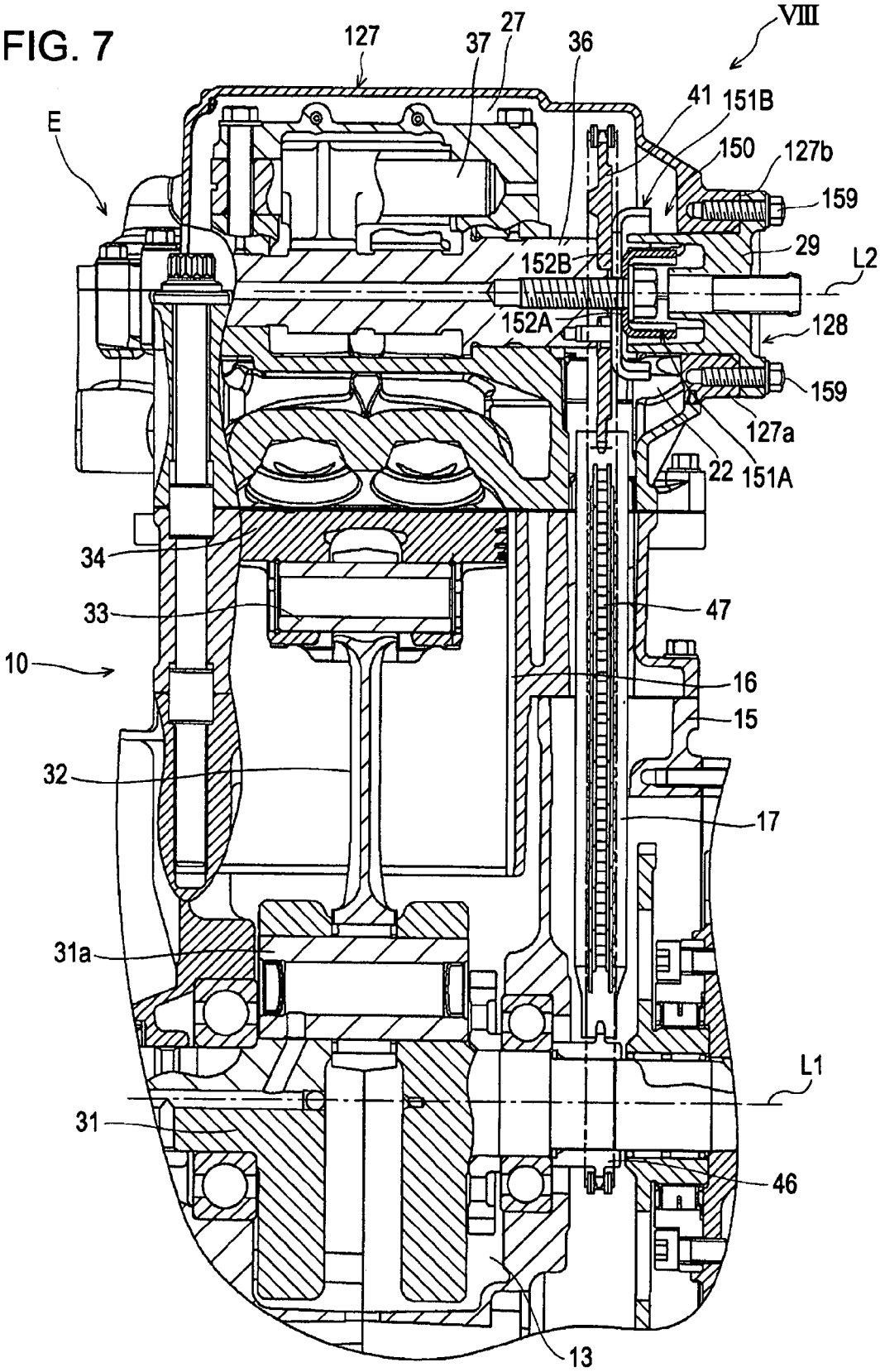
FIG. 7 is a cross-sectional view of an engine having a breather device according to a second embodiment of the present invention.
Figure 8:
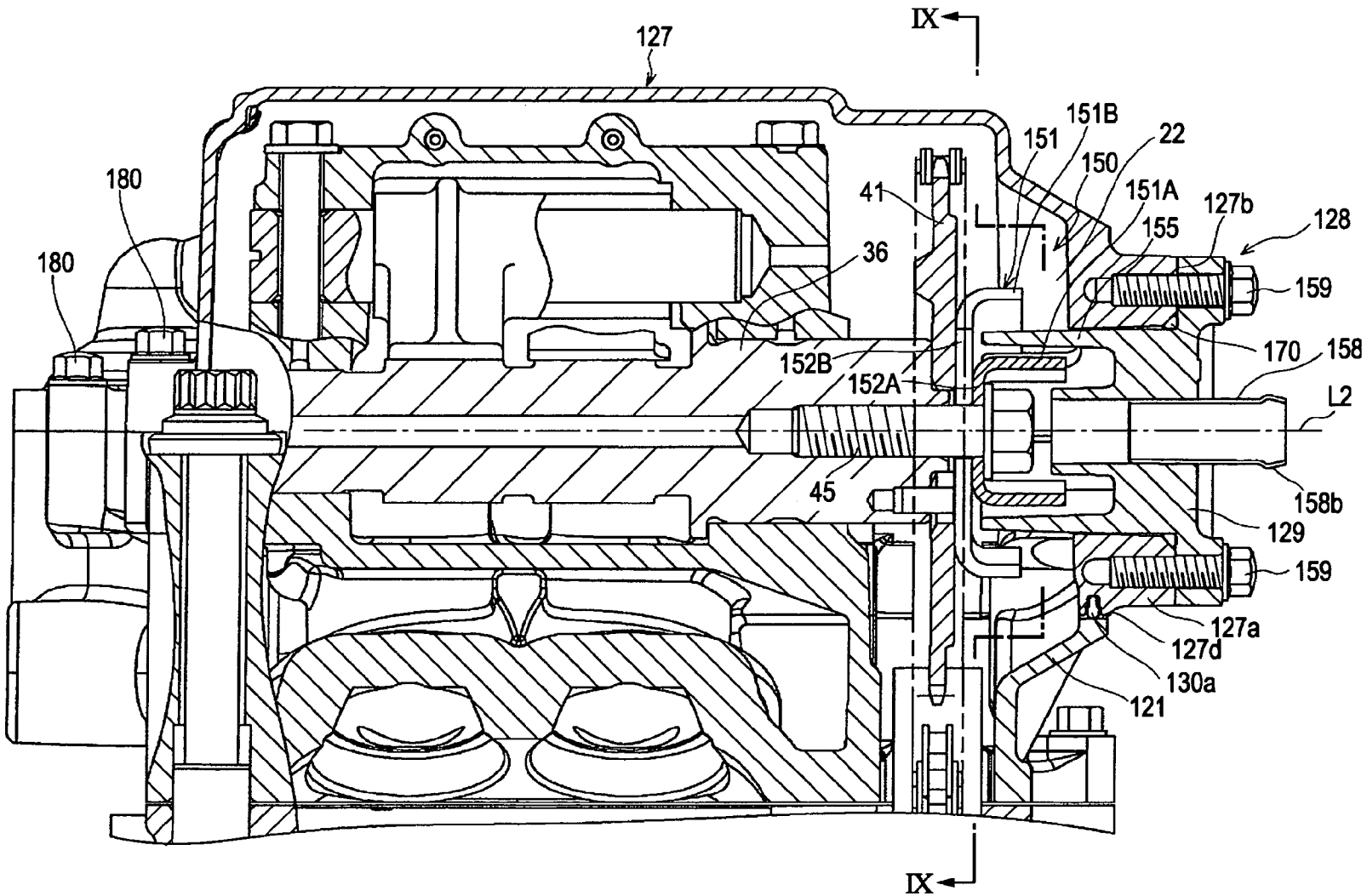
FIG. 8 is an enlarged cross-sectional view of part VIII in FIG. 7.
Figure 9:
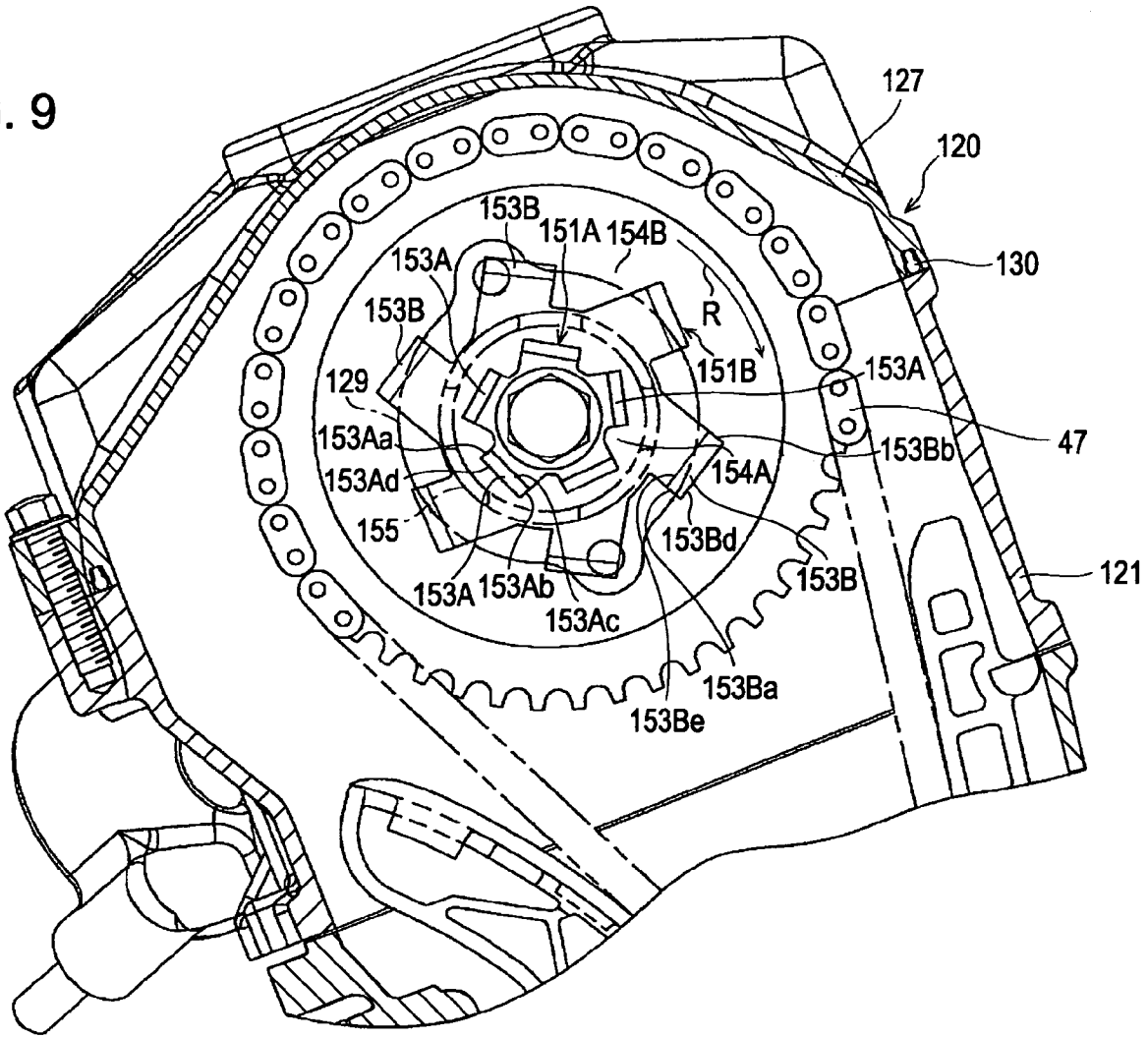
FIG. 9 is a cross-sectional view taken along line IX-IX in FIG. 8.
Figure 10:
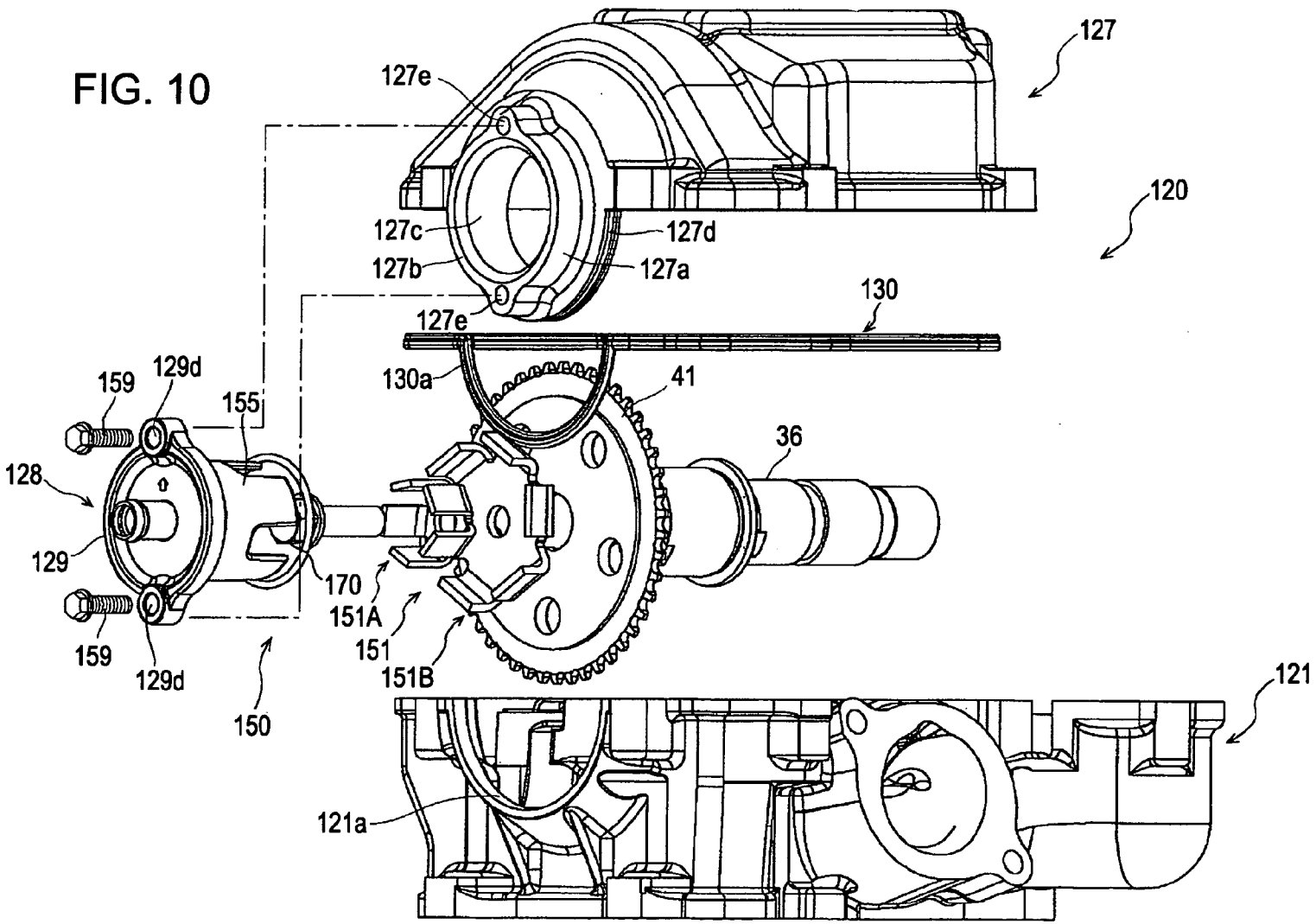
FIG. 10 is a perspective view of the breather device shown in FIG. 7 and a cylinder head of the engine equipped with the breather device.
Figure 11:
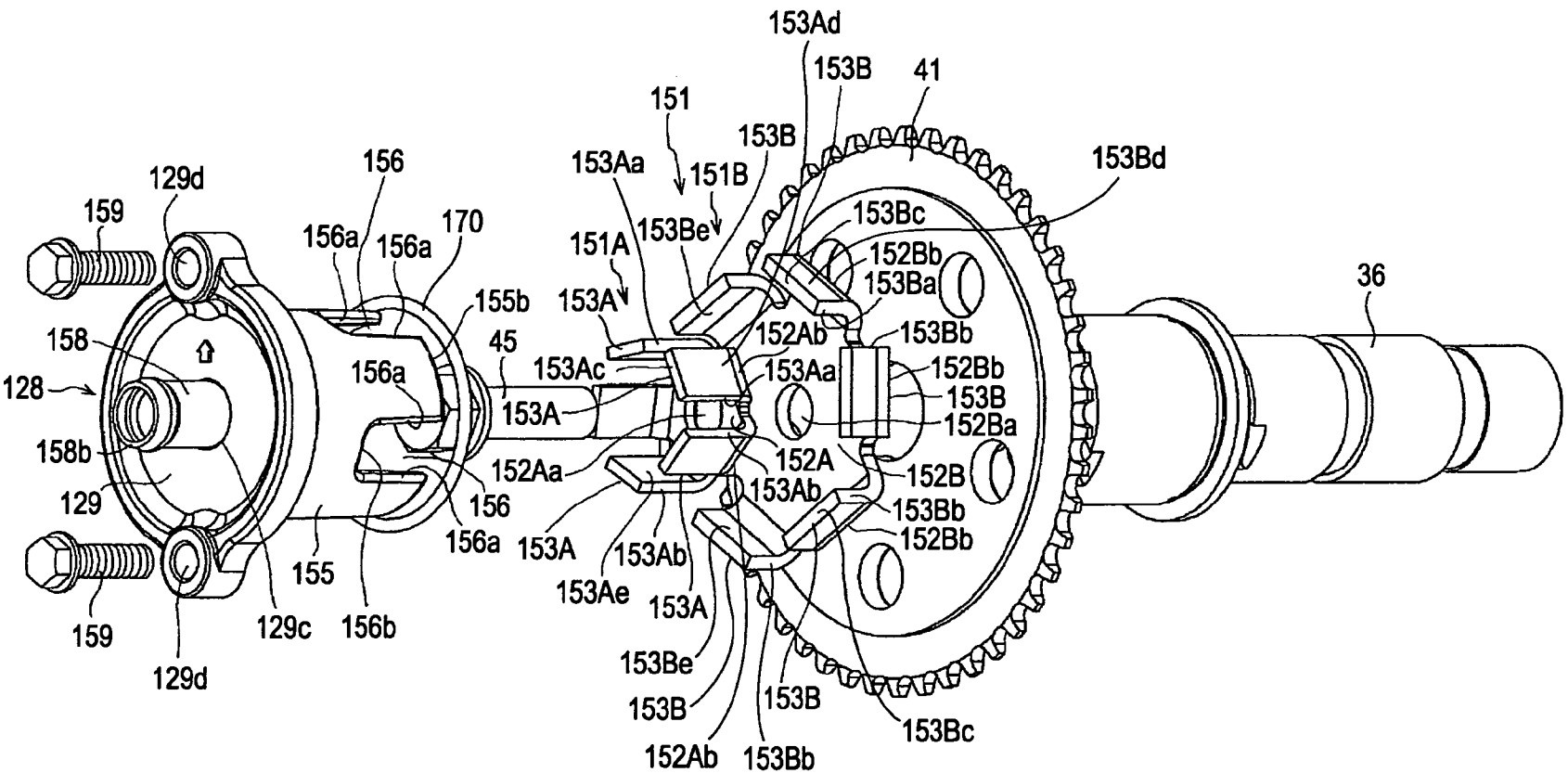
FIG. 11 is a perspective view of the breather device shown in FIG. 7.

FIGS. 7 to 12F illustrate a second embodiment of the present invention. FIG. 7 is a cross-sectional view of an engine having a breather device according to the second embodiment. FIG. 8 is an enlarged view of part VIII in FIG. 7. FIG. 9 is a cross-sectional view taken along line IX-IX in FIG. 8. FIG. 10 is an exploded perspective view of a cylinder head. FIG. 11 is a perspective view showing a relationship between the breather device and a camshaft. FIGS. 12A to 12F illustrate relationships between inner and outer fins included in an oil separator having a dual structure.

In the second embodiment, the mechanisms, components, members, and portions that are the same as those in the engine described in the first embodiment are given the same reference characters or numerals, and detailed descriptions thereof will not be repeated.

Referring to FIG. 7, reference character E denotes an engine, reference numeral 10 denotes an engine body, 13 denotes a crank chamber, 15 denotes a cylinder block, 16 denotes a cylinder, 17 denotes a communication path connecting the crank chamber 13 and a timing-gear chamber 22, 27 denotes a valve-operating chamber, 31 denotes a crankshaft, 31*a* denotes a crankpin, 32 denotes a connecting rod, 33 denotes a piston pin, 34 denotes a piston, 36 denotes a camshaft, 37 denotes a rocker shaft, 46 denotes a sprocket, and 47 denotes a cam chain.

Referring to FIGS. 7 and 8, a breather device 150 according to the second embodiment is disposed within the timing-gear chamber 22. In the second embodiment, the breather device 150 is applied to an engine having a camshaft with a more complex valve-operating structure than that of the camshaft in the first embodiment. An example of such a camshaft is a camshaft for twin rocker shafts in a four-valve engine.

With such a camshaft having a complex valve-operating structure, it is difficult to attach the camshaft to the cylinder head by fitting the camshaft into the camshaft holes in the cylinder head as described in the first embodiment. Therefore, referring to FIG. 10, a cylinder head 120 in the second embodiment is divided into upper and lower components with respect to a plane through which the axis line L2 of the camshaft 36 extends. The camshaft 36 is attached to the cylinder head 120 by being sandwiched between the upper and lower components at the dividing plane. More specifically, as shown in FIG. 10, the cylinder head 120 is divided into a cylinder-head body 121 and a rocker cover 127, such that a camshaft hole is divided into an upper half section and a lower half section with respect to a mating plane at which the cylinder-head body 121 and the rocker cover 127 are to be combined with each other. Consequently, when the cylinder-head body 121 and the rocker cover 127 are combined with each other at this mating plane, a camshaft hole for rotatably supporting the camshaft 36 is formed. Referring to FIG. 8, the cylinder-head body 121 and the rocker cover 127 are combined with each other by means of connecting bolts 180.

The cylinder head 120 has a valve-operating chamber that is covered by the rocker cover 127. This valve-operating chamber has therein a valve-operating mechanism including, for example, the rocker shaft 37, an exhaust rocker arm, and an intake rocker arm.

Similar to the first embodiment, when the cylinder-head body 121 and the rocker cover 127 are combined with each other, the sprocket 41 and the timing-gear chamber 22 accommodating the breather device 150 are disposed beside the camshaft hole. The sprocket 41 and an oil separator 151 of the breather device 150 are both attached to one end of the camshaft 36 so as to be supported within the timing-gear chamber 22. As in the first embodiment, when the crankshaft 31 rotates, the camshaft 36 and the oil separator 151 are rotated through a timing transmission mechanism constituted by the sprocket 46, the cam chain 47, and the sprocket 41. The timing transmission mechanism is accommodated within an accommodation chamber constituted by the communication path 17 and the timing-gear chamber 22 communicating with the communication path 17.

Like the first embodiment, the second embodiment is provided with a side cover 128 that holds a breather housing 155 included in the breather device 150 and covers a side of the timing-gear chamber 22. The side cover 128 is mounted to the rocker cover 127. In this case, since the cylinder head 120 is divided into upper and lower components, i.e. the cylinder-head body 121 and the rocker cover 127, with respect to the plane through which the axis line L2 of the camshaft 36 extends, it is difficult to form on the cylinder head 120 an side cover mounting surface that can extend over the mating line, i.e. the mating plane, between the cylinder-head body 121 and the rocker cover 127, as viewed in a direction from the side cover 128. Even if it is possible to form such a side cover mounting surface, the side cover mounting surface will have a complicated structure and will thus be expensive, leading to an increase in costs.

The rocker cover 127 of the engine E is given a specific structure for solving this problem. Specifically, referring to FIG. 10, one side of the rocker cover 127 of the cylinder head 120 is integrally provided with a side-cover attachment portion 127*a* at a position facing the sprocket 41.

The side-cover attachment portion 127*a* has a side-cover attachment flange 127*b* that has a ring shape and projects from the rocker cover 127 along the axis line L2. A central portion of the side-cover attachment flange 127*b* is provided with a breather-housing insertion hole 127*c* through which the breather housing 155 can be inserted into the timing-gear chamber 22. When the rocker cover 127 of the cylinder head 120 is joined to the cylinder-head body 121 with the camshaft 36 sandwiched therebetween, the axis line L2 of the camshaft 36 extends through the center of the breather-housing insertion hole 127*c*.

The lower half of the side-cover attachment flange 127*b* projects downward so as to be disposed lower than a mating plane between the rocker cover 127 and the cylinder-head body 121. This downward projecting portion of the side-cover attachment flange 127*b* is provided with a semicircular edge surface 127*d* that faces the cylinder-head body 121. On the other hand, the cylinder-head body 121 is provided with a semicircular receiving surface 121*a* for receiving the semicircular edge surface 127*d*. The semicircular receiving surface 121*a* and the semicircular edge surface 127*d* have a sealing member 130 interposed therebetween. Thus, the semicircular receiving surface 121*a* is given a radius slightly larger than that of the semicircular edge surface 127*d* for the thickness of the sealing member 130.

The sealing member 130 interposed between the rocker cover 127 and the cylinder-head body 121 has a single endless body of an annular shape. A part of the sealing member 130 has a shape that corresponds to that of the semicircular receiving surface 121*a*. When the rocker cover 127 and the cylinder-head body 121 are combined, the sealing member 130 intervenes the rocker cover 127 and the cylinder-head body 121 at the mating plane (see FIG. 9), whereby the inside of the cylinder head 120 can be hermetically sealed from the outside.

A process for attaching the side cover 128 onto the side-cover attachment portion 127*a* will now be described. First, the breather housing 155 is inserted into the breather-housing insertion hole 127*c*. Then, mounting bolts 159 are inserted into bolt through-holes 129*d* provided in a cover body 129 of the side cover 128. These mounting bolts 159 are inserted and bolted to respective bolt holes 127*e* provided in the side-cover attachment flange 127*b*. In this case, a seal ring 170 is interposed between the side-cover attachment flange 127*b* and the cover body 129 of the side cover 128 so as to form a hermetic seal between the side-cover attachment flange 127*b* and the cover body 129.

The following is a detailed description of the breather device 150 according to the second embodiment in which the side cover 128 can be readily attached to the cylinder head 120 that is divided into the upper and lower components with respect to the plane through which the axis line L2 of the camshaft 36 extends.

Referring to FIGS. 7 to 12F, in the breather device 150, the oil separator 151 has a dual structure that includes two annular fin arrays having different diameters. Specifically, the two annular fin arrays include an inner annular fin array 151A and an outer annular fin array 151B.

The inner annular fin array 151A and the outer annular fin array 151B each have a substantially similar structure to that of the oil separator 51 in the first embodiment. Referring to FIG. 11, the inner annular fin array 151A has a pentagonal plate-like base 152A with a mounting hole 152Aa in the center. The base 152A has edges 152Ab from which a plurality of fins 153A extends in a direction away from the camshaft 36 along the axis line L2 (see FIGS. 7 and 8). The fins 153A are in the form of rectangular flat plates and are arranged annularly at fixed intervals. Referring to FIG. 9, each of these fins 153A is slanted such that a leading edge 153Aa thereof, as viewed in the rotational direction R of the camshaft 36, is closer to the axis line L2 than a trailing edge 153Ab thereof is to the axis line L2. In other words, the trailing edge 153Ab is farther from the axis line L2 than the leading edge 153Aa is from the axis line L2. Furthermore, the adjacent fins 153A have gaps 154A therebetween that extend in the direction of the axis line L2.

On the other hand, like the inner annular fin array 151A, the outer annular fin array 151B also has a plate-like base 152B. The base 152B of the outer annular fin array 151B is hexagonal and has a mounting hole 152Ba in the center. The base 152B has edges 152Bb from which a plurality of fins 153B extends in a direction away from the camshaft 36 along the axis line L2 (see FIGS. 7 and 8). The fins 153B are in the form of rectangular flat plates and are arranged annularly at fixed intervals. Referring to FIG. 9, each of these fins 153B is slanted such that a leading edge 153Ba thereof, as viewed in the rotational direction R of the camshaft 36, is closer to the axis line L2 than a trailing edge 153Bb thereof is to the axis line L2. In other words, the trailing edge 153Bb is farther from the axis line L2 than the leading edge 153Ba is from the axis line L2. Furthermore, the adjacent fins 153B have gaps 154B therebetween that extend in the direction of the axis line L2.

Referring to FIG. 8, the inner annular fin array 151A and the outer annular fin array 151B having the above-described structures are disposed such that the base 152A of the inner annular fin array 151A overlies the base 152B of the outer annular fin array 151B. In addition, in a state where the mounting holes 152Aa and 152Bb are aligned, the inner annular fin array 151A and the outer annular fin array 151B are coaxially attached to one end of the camshaft 36, along with the sprocket 41, by means of the mounting bolt 45.

On the other hand, referring to FIG. 11, the breather housing 155 provided on the cover body 129 of the side cover 128 has a cylindrical shape with five openings 156 (see FIG. 9) arranged in the circumferential direction thereof. The openings 156 are open at the side of a tip end 155*b* of the breather housing 155. Specifically, each opening 156 has a substantially U-shape defined by opposite side edges 156*a* that extend along the axis line L2 and by a base-side edge 156*b* that connects the ends of the opposite side edges 156*a* proximate to the cover body 129. These U-shaped openings 156 can be readily formed mechanically by, for example, cutting from the side of the tip end 155*b*. When the breather housing 155 is installed in the timing-gear chamber 22, these openings 156 face outer surfaces 153Ad of the inner annular fin array 151A and inner surfaces 153Be of the outer annular fin array 151B.

Referring to FIG. 8, when the side cover 128 is attached to the side-cover attachment flange 127*b*, the breather housing 155 is disposed,between the inner annular fin array 151A and the outer annular fin array 151B while being spaced apart from these annular fin arrays by predetermined distances. In this state, the base-side edges 156*b* of the openings 156 are preferably set so as to be closer to the camshaft 36 than tip ends 153Ac of the fins 153A of the inner annular fin array 151A are to the camshaft 36. Moreover, any one of the openings 156 in the breather housing 155 is preferably positioned so as to face the downward direction of the engine E.

The cover body 129 of the side cover 128 has a breather-pipe attachment hole 129*c* that is coaxially aligned with the axis line L2. The breather-pipe attachment hole 129*c* holds a breather pipe 158 by allowing the breather pipe 158 to be fitted therein. The breather pipe 158 has an outlet port 158*b* that communicates with an intake system of the engine E, such as the air cleaner 60 shown in FIG. 2.

As described above, when the oil separator 151 is mounted to one end of the camshaft 36 with the mounting bolt 45, the fins 153A of the inner annular fin array 151A are arranged with a predetermined distance from the fins 153B of the outer annular fin array 151B. In this state, when viewed in a radially outward direction from the axis line L2 of the camshaft 36, the gaps 154A in the inner annular fin array 151A at least partially overlap the fins 153B of the outer annular fin array 151B.

FIGS. 12A to 12F illustrate how the gaps 154A and the fins 153B can be made to overlap each other readily by giving the inner annular fin array 151A and the outer annular fin array 151B different numbers of fins 153A and fins 153B, respectively. In this example, the inner annular fin array 151A is provided with five fins 153A, whereas the outer annular fin array 151B is provided with six fins 153B.

Figure 12A:
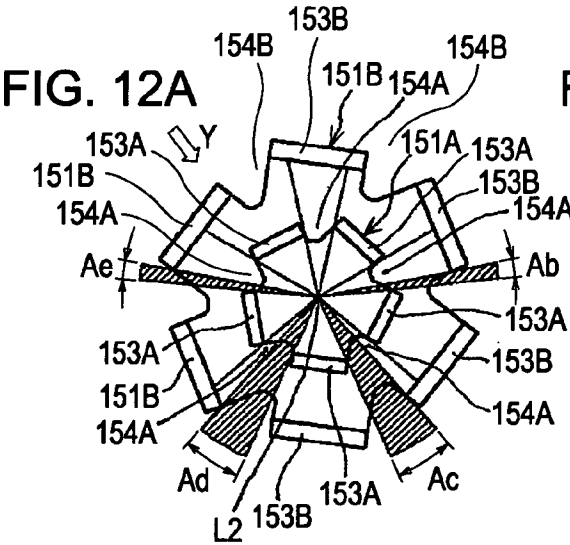
FIGS. 12A to 12F illustrate relationships between two coaxial oil-separator components at six different angular positions, respectively.
Figure 12B:
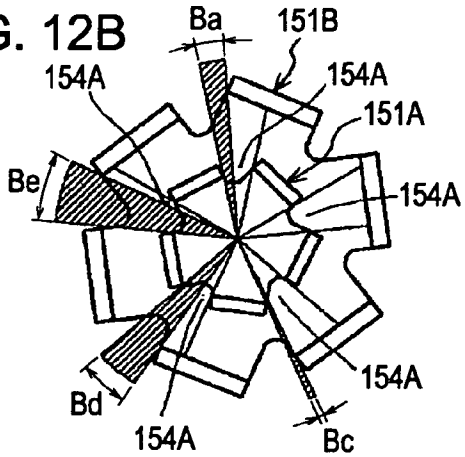
Figure 12C:
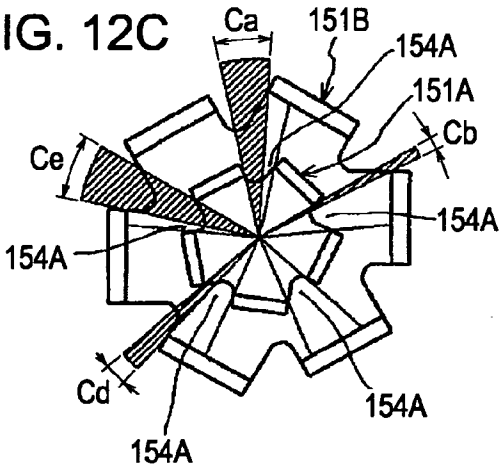
Figure 12D:
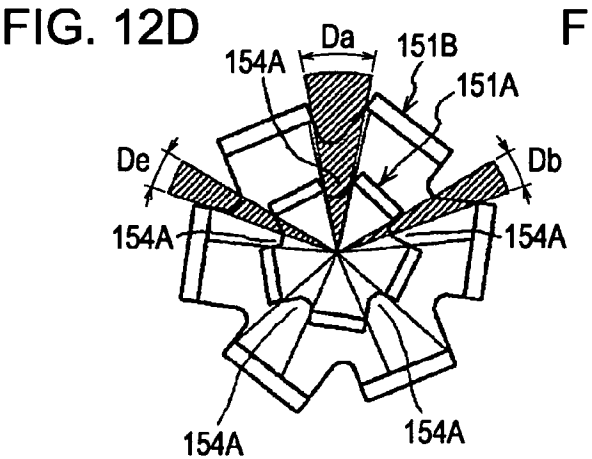
Figure 12E:
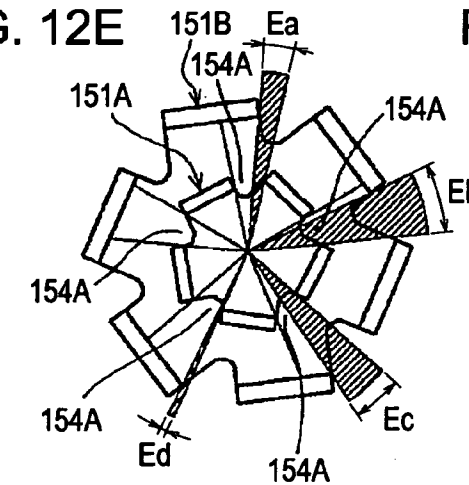
Figure 12F:
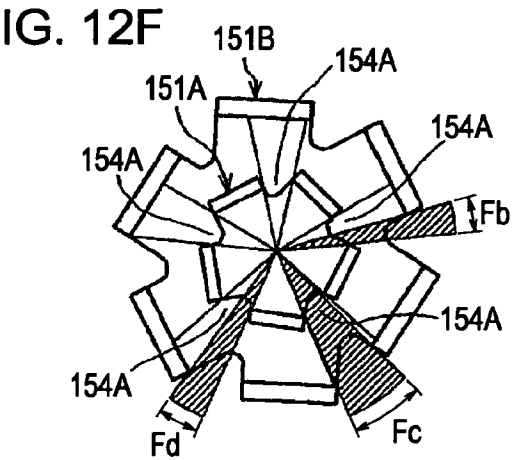
Figure 13:
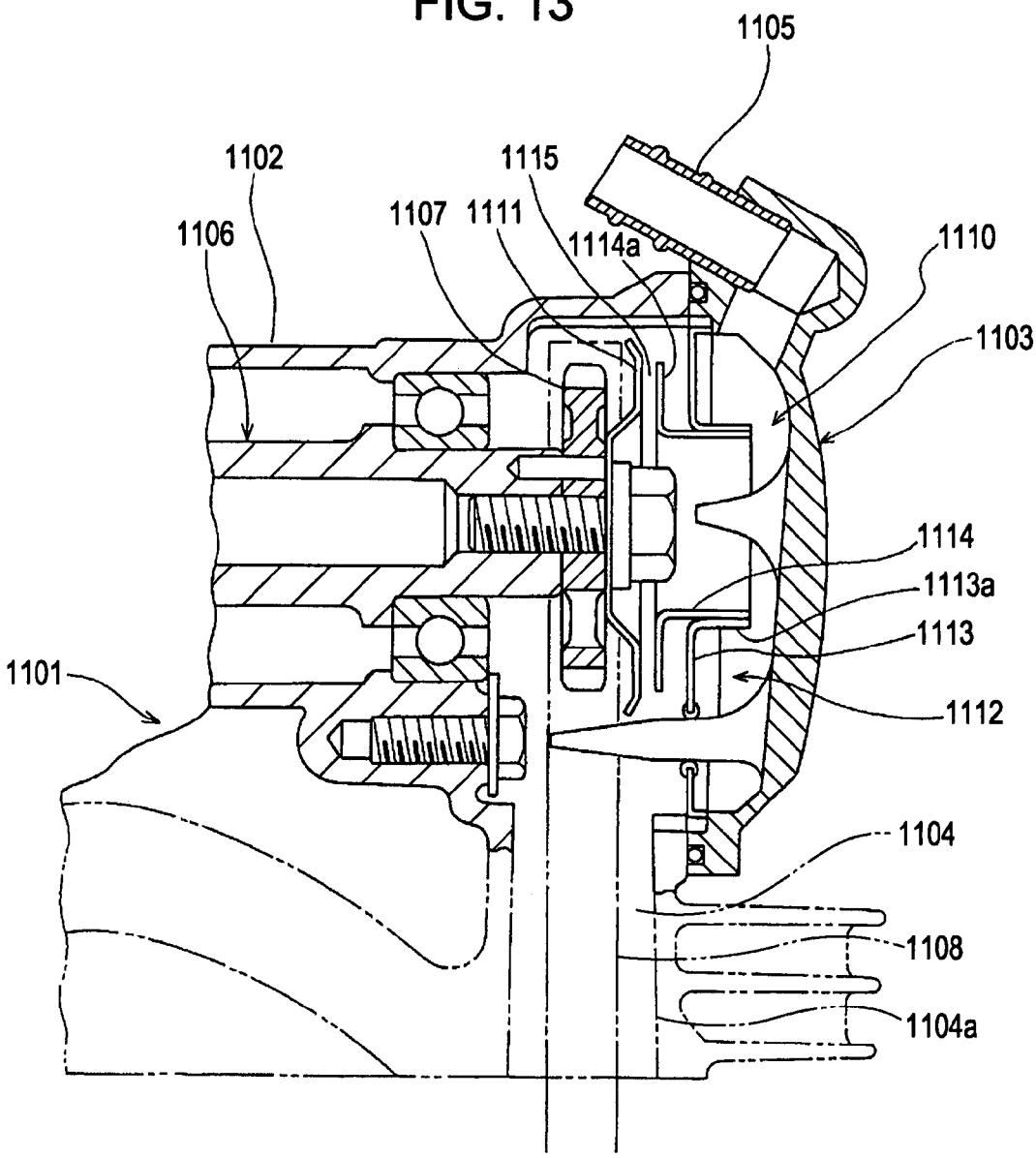
FIG. 13 is a cross-sectional view of a breather device of related art.
Figure 14:
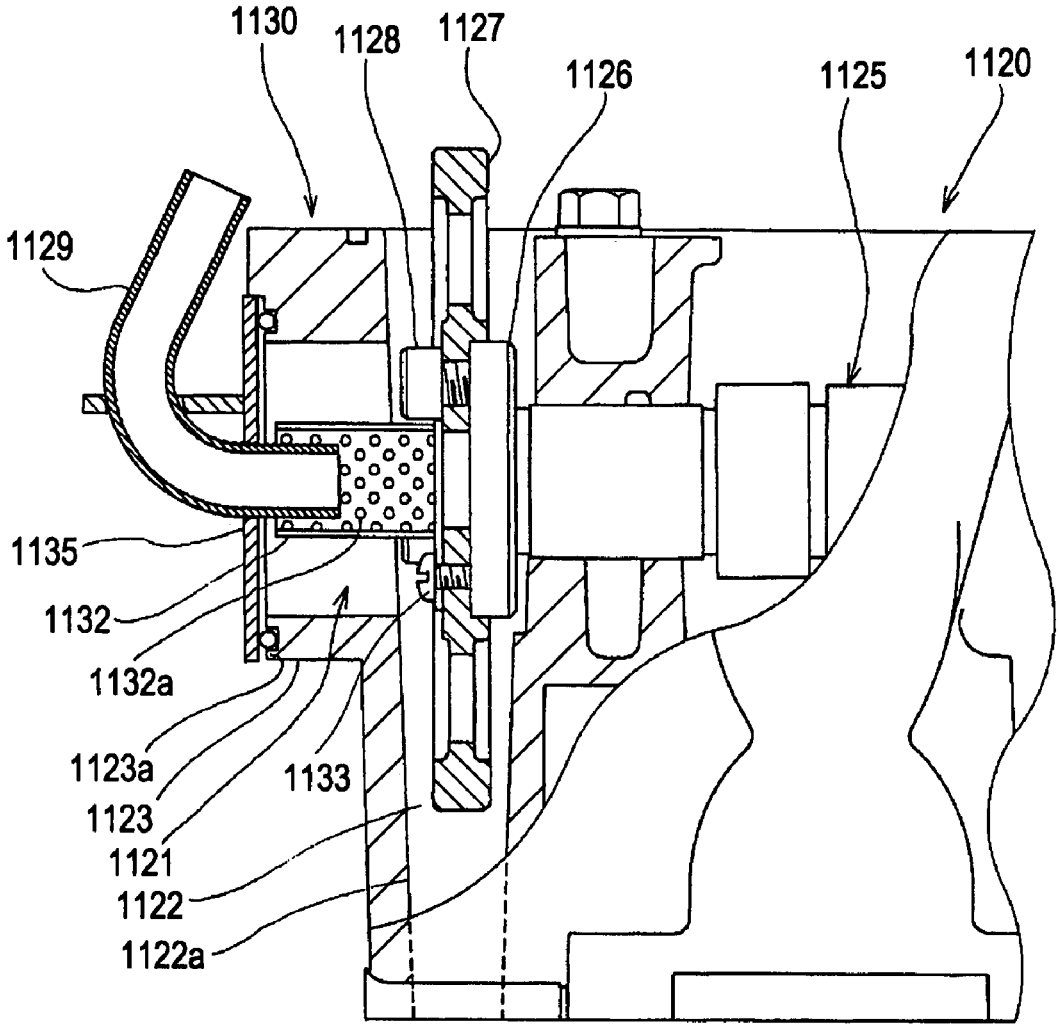
FIG. 14 is a cross-sectional view of another breather device of related art.

FIGS. 12A to 12F show the relationships the outer annular fin array 151B has with the inner annular fin array 151A at six mounting-angle positions when the outer annular fin array 151B is shifted angularly with respect to the inner annular fin array 151A. In detail, FIG. 12A corresponds to a reference position. FIG. 12B corresponds a mounting-angle position when the outer annular fin array 151B is rotated clockwise by about 15° from the reference position. Likewise, FIGS. 12C to 12F correspond to mounting-angle positions when the outer annular fin array 151B is rotated clockwise by about 20°, 30°, 45°, and 55°, respectively. In every one of these mounting-angle positions, the gaps 154A in the inner annular fin array 151A and the fins 153B in the outer annular fin array 151B partially overlap.

When the inner and outer annular fin arrays 151A and 151B having different numbers of fins are to be attached to the camshaft 36, the aforementioned overlapping state can be attained without having to consider the mounting-angle positions therebetween by simply combining and fastening the inner and outer annular fin arrays 151A and 151B and the sprocket 41 together onto the camshaft 36 with a bolt. Accordingly, this significantly facilitates the attachment process of the oil separator 151 and eliminates the need for performing a positioning step between the oil-separator components, thereby simplifying the structure of the oil separator 151 as well as reducing the cost of manufacture of the oil separator 151.

The operation of the breather device 150 according to the second embodiment will now be described.

Blow-by gas flowing into the timing-gear chamber 22, which is part of the accommodation chamber that accommodates the timing transmission mechanism, comes into contact with the rotating outer annular fin array 151B. In this case, the oil mist contained in the blow-by gas adheres to the fins 153B due to the viscosity of the oil mist itself, and thus is separated from the blow-by gas. The blow-by gas with the oil mist partly removed therefrom by the outer annular fin array 151B passes through the openings 156 of the breather housing 155 so as to flow into the breather housing 155. In this case, the blow-by gas comes into contact with the inner annular fin array 151A, and the oil mist remaining in the blow-by gas adheres to the fins 153A so as to be separated from the blow-by gas. The blow-by gas with the oil mist removed therefrom is supplied to an air cleaner (see reference numeral 60 in FIG. 2) through the breather pipe 158 that communicates with the interior of the inner annular fin array 151A.

The oil mist adhered to the fins 153B of the outer annular fin array 151B is scattered due to a centrifugal force generated by the rotating outer annular fin array 151B and thus adheres to the wall 22*a* of the timing-gear chamber 22. The oil mist then flows downward along the wall 22*a* towards the crank chamber 13. On the other hand, the oil mist scattered from the inner annular fin array 151A is received by an inner periphery surface 155*c* of the breather housing 155 and flows outward through the openings 156. A portion of the oil mist passes through the gaps 154B between the fins 153B of the outer annular fin array 151B and travels along the wall 22*a* of the timing-gear chamber 22 as droplets. These droplets of oil mist partly drip to the inner surfaces 153Be of the fins 153B in the outer annular fin array 151B. The oil adhered to the inner surfaces 153Be of the fins 153B flows toward the trailing edges 153Bb of the fins 153B due to the centrifugal force and wind pressure generated upon the rotation of the outer annular fin array 151B. The oil then passes through the gaps 154B and scatters onto the wall 22*a* of the timing-gear chamber 22 so as to adhere to the wall 22*a*. The oil adhered to the wall 22*a* travels along the wall 22*a* so as to flow downward to the crank chamber 13.

The effects and advantages achieved due to the slanted structures of the fins 153A and 153B of the respective inner and outer annular fin arrays 151A, 151B are the same as in the first embodiment.

Of the blow-by gas having oil mist removed therefrom and flowing into the inner annular fin array 151A, the blow-by gas near the center of the inner annular fin array 151A, which has less density and has an extremely small amount of oil mist remaining therein, is released through the breather pipe 158, as in the first embodiment.

Furthermore, the effects and advantages achieved due to the tip ends 153Ac of the fins 153A in the inner annular fin array 151A being disposed closer towards the side cover 128 than the base-side edges 156*b* of the openings 156 in the breather housing 155 are towards the side cover 128 are the same as in the first embodiment.

Since the oil separator in the second embodiment is constituted by a plurality of annular fin arrays, the oil separator of the second embodiment can remove oil mist from blow-by gas more effectively than an oil separator constituted by a single annular fin array, thereby achieving an enhanced gas-liquid separation effect.

Especially in a case that the number of fins in the inner annular fin array is different from the number of the fins in the outer annular fin array, a condition where the blow-by gas does not come into contact with any of the fins is reduced, at any mounting angle. Accordingly, this prevents the gas-liquid separation effect from varying with the mounting angle of the oil separator, whereby the effect of the present invention can be achieved uniformly. In addition, the process for attaching the oil separator to the camshaft can be performed readily without having to perform a specific positioning step for the oil separator.

The technical scope of the present invention is not limited to the above embodiments, and modifications are permissible without departing from the scope of the invention. For example, the number of fins in the oil separator and the number of openings provided in the breather housing are appropriately changeable. Furthermore, the openings in the breather housing do not necessarily need to be U-shaped, and may alternatively be circular or rectangular.

The oil separator may have a multilayer structure of three or more layers. In that case, two or more breather housings may be used, such that each breather housing is disposed around an outer periphery of one of or at least two of the oil-separator components.

As a timing transmission mechanism, a toothed belt or a timing belt may be used in place of a cam chain, and wound around timing pulleys of the crankshaft and the camshaft.

What is claimed is:

1. A breather device in an engine including a cylinder head having a timing-gear chamber that accommodates a cam sprocket fixed to one end of a rotatably supported camshaft and communicates with a crank chamber, the cam sprocket being rotatable in conjunction with a crankshaft rotatably supported within the crank chamber, the breather device removing oil mist from blow-by gas in the engine and allowing the blow-by gas to be circulated into an intake system, the breather device comprising:

an oil separator having a base attached to the one end of the camshaft and a plurality of fins that are spaced apart from each other and project from the base in a direction away from the camshaft;

a side cover including a cover body detachably attached to a side-cover attachment part and a breather housing having a tubular portion that projects into the timing-gear chamber from the cover body and is open towards the camshaft, the side-cover attachment part being provided beside the timing-gear chamber and having an opening that faces a side surface of the cam sprocket; and a breather pipe disposed in the cover body and allowing the blow-by gas inside the oil separator to be circulated into the intake system, wherein the breather housing has a plurality of openings in the tubular portion thereof and covers the oil separator in a rotatable manner.

2. A breather device in an engine, the breather device removing oil mist contained in blow-by gas flowing into an accommodation chamber and allowing the blow-by gas to be circulated into an intake system, the accommodation chamber accommodating a timing transmission mechanism that transmits rotation of a crankshaft of the engine to a camshaft, the breather device comprising:

an oil separator including at least one annular fin array having a plurality of fins projecting into the accommodation chamber from one end of the camshaft and arranged annularly around an axis line of the camshaft at certain intervals;

a side cover detachably attached to one side of the accommodation chamber;

a tubular breather housing projecting into the accommodation chamber from the side cover and accommodating at least a part of the oil separator; and a breather pipe attached to the side cover and communicating with an inside of the breather housing, the breather pipe allowing the blow-by gas with the oil mist removed therefrom by the oil separator to be circulated into the intake system.

3. The breather device according to claim 2, wherein the the oil separator comprises a plurality of annular fin arrays.

4. The breather device according to claim 3, wherein the breather housing is disposed between the plurality of annular fin arrays and partially accommodates the annular fin arrays.

5. The breather device according to claim 2, wherein each of the fins is in a form of a rectangular plate and is slanted such that a leading edge of the fin, as viewed in a rotational direction of the camshaft, is closer to the axis line of the camshaft than a trailing edge of the fin is to the axis line.

6. The breather device according to claim 2, wherein the breather pipe has an inlet port for the blow-by gas, the inlet port being disposed on the axis line of the camshaft.

7. The breather device according to claim 2, wherein the breather housing has a plurality of substantially U-shaped openings that are open at a tip-end side of the breather housing, each of the substantially U-shaped openings being defined by opposite side edges extending along the axis line of the camshaft and by a base-side edge that connects ends of the opposite side edges.

8. The breather device according to claim 7, wherein the fins have tip ends in an axial direction of the camshaft, the tip ends of the fins being positioned closer towards the cover body than the base-side edges of the openings in the breather housing are towards the cover body.

9. The breather device according to claim 2, wherein the breather housing has a tip end in an axial direction of the camshaft, the tip end of the breather housing abutting on a side surface of the timing transmission mechanism.

10. The breather device according to claim 2, wherein the oil separator and the timing transmission mechanism are fixed together with a mounting bolt to the one end of the camshaft projecting into the accommodation chamber.

11. A breather device in an engine, comprising:

an oil separator that removes oil mist contained in blow-by gas flowing into an accommodation chamber and allows the blow-by gas to be circulated into an intake system, the accommodation chamber accommodating a timing transmission mechanism that transmits rotation of a crankshaft of the engine to a camshaft, the oil separator being attached to one end of the camshaft, wherein the oil separator includes a plurality of annular fin arrays, each annular fin array having a plurality of fins projecting from the one end of the camshaft and arranged annularly around an axis line of the camshaft at certain intervals.

12. The breather device according to claim 11, wherein the plurality of annular fin arrays comprises an inner annular fin array and an outer annular fin array disposed radially adjacent to each other in the oil separator, wherein the number of fins in the inner annular fin array is different from the number of fins in the outer annular fin array, and wherein the inner and outer annular fin arrays are disposed such that the fins in the outer annular fin array at least partially overlap the gaps between the fins in the inner annular fin array.

13. The breather device according to claim 11, wherein each of the fins is slanted such that a leading edge of the fin, as viewed in a rotational direction of the camshaft, is closer to the axis line of the camshaft than a trailing edge of the fin is to the axis line.

14. The breather device according to claim 11, further comprising a side cover including a cover body detachably attached to one side of the accommodation chamber and a tubular breather housing projecting into the accommodation chamber from the cover body and being open towards the camshaft, wherein the breather housing has a plurality of openings arranged along a circumference thereof, the breather housing being disposed between the annular fin arrays and being spaced apart from the annular fin arrays by predetermined distances, the annular fin arrays being disposed radially adjacent to each other in the oil separator.

* * * * *